US006534256B2

(12) United States Patent
Kiyoto

(10) Patent No.: US 6,534,256 B2
(45) Date of Patent: Mar. 18, 2003

(54) SILVER HALIDE PHOTOGRAPHIC LIGHTSENSITIVE MATERIAL

(75) Inventor: Naoharu Kiyoto, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/820,229

(22) Filed: Mar. 29, 2001

(65) Prior Publication Data

US 2002/0009681 A1 Jan. 24, 2002

(30) Foreign Application Priority Data

Mar. 29, 2000 (JP) ..... 2000-091213

(51) Int. Cl.[7] ..... G03C 1/035; G03C 1/005
(52) U.S. Cl. ..... 430/567; 430/505; 430/569
(58) Field of Search ..... 430/505, 567, 430/568, 569

(56) References Cited

U.S. PATENT DOCUMENTS 4,952,485 A 8/1990 Shibahara et al.
5,047,317 A 9/1991 Shibayama et al.
5,091,293 A 2/1992 Nozawa et al.
5,310,635 A * 5/1994 Szajewski ..... 430/496
5,474,887 A * 12/1995 Reed et al. ..... 430/567
5,616,453 A * 4/1997 Sekiya et al. ..... 430/504
5,962,206 A * 10/1999 Hall ..... 430/506
5,994,042 A * 11/1999 Bringley et al. ..... 430/506
5,998,114 A * 12/1999 Bringley et al. ..... 430/506

OTHER PUBLICATIONS

English language translation of JP 08–334850.*

* cited by examiner

*Primary Examiner*—Janet Baxter
*Assistant Examiner*—Amanda C. Walke
(74) *Attorney, Agent, or Firm*—Birch, Stewart, Kolasch & Birch, LLP

(57) ABSTRACT

A silver halide photographic lightsensitive material comprises at least one lightsensitive silver halide emulsion layer on a support. The lightsensitive material exhibits a speed at $3\times10^{-9}$ sec exposure time being lower than a speed at $10^{-5}$ sec exposure time by 30 or more in terms of speed unit.

24 Claims, No Drawings

SILVER HALIDE PHOTOGRAPHIC LIGHTSENSITIVE MATERIAL

CROSS-REFERENCE TO RELATED APPLICATIONS

This application is based upon and claims the benefit of priority from the prior Japanese Patent Application No. 2000-091213, filed Mar. 29, 2000, the entire contents of which are incorporated herein by reference.

BACKGROUND OF THE INVENTION

The present invention relates to a silver halide photographic lightsensitive material improved with respect to a ratio of photographic speed/radiation fog.

In recent years, the demands for photographic lightsensitive materials, especially lightsensitive materials for photographing, are becoming stricter. It is now demanded to attain not only a high photographic speed but also a further reduction of radiation fog. Thus, it is desired to develop an emulsion improved with respect to them.

The techniques for enhancing the photographic speed of silver halide emulsions include one wherein tabular silver halide grains (hereinafter simply referred to as "tabular grains") are incorporated in silver halide emulsions. With respect to tabular grains, for example, U.S. Pat. Nos. 4,434,226, 4,439,520, 4,414,310, 4,433,048, 4,414,306 and 4,459,353, Jpn. Pat. Appln. KOKAI Publication No. (herein after referred to as JP-A-) 59-99433 and JP-A-62-209445 disclose processes for producing the same and techniques for use thereof. It is known that the tabular grains are advantageous in attaining, for example, an enhancement of photographic speed including enhancement of color sensitization efficiency by sensitizing dyes, an enhancement of photographic speed/graininess relations, an enhancement of sharpness attributed to specific optical properties of tabular grains, and an enhancement of covering power. Generally, in enhancing the photographic speed of silver halide emulsions, it is effective to employ tabular grains of large size and high aspect ratio.

On the other hand, it has been found that, the greater the enhancement of photographic speed, the more serious the problem of photographic performance deterioration by prolonged storage. The problem is especially serious with respect to color negative photographic lightsensitive materials with a photographic speed of ISO 400 or more. The causes of the photographic performance deterioration by prolonged storage involve not only hitherto well-known heat and moisture but also natural radiation (environmental radiation or cosmic rays). The lightsensitive material having been exposed to natural radiation suffers from an increase of fog density and, accompanying the same, a deterioration of graininess. As countermeasures to the deterioration of photographic performance by natural radiation, there are known, for example, the method of reducing the coating amount of silver (JP-A-63-226650 and JP-A-63-226651) and the method of reducing the potassium content of photographic lightsensitive materials (JP-A-2-836). Further, as measures for reducing the radiation fog, there are known the method of adding a mercaptoazole-type dye (JP-A-2-190851), the method of using a compound other than chloroauric acid as a gold sensitizer (JP-A-4-67032, JP-A-4-68337 and JP-A-4-75053), and the method of forming development initiation points on a single plane (for example, JP-A-5-216246). However, the tabular grains of large equivalent circle diameter and small grain thickness tend to suffer from radiation fog, and hence only the measures described in the above patent application specifications do not provide satisfactory countermeasures to the deterioration of photographic performance by natural radiation. Therefore, there is a demand for simultaneously attaining an enhancement of photographic speed and an enhancement of resistance to radiation with respect to these grains.

Moreover, in the above patent application specifications, there is no description relating to the speed at 3×10 9 sec exposure time being lower than the speed at $10^{-5}$ sec exposure time by 30 or more in terms of speed unit, which is a feature of the emulsion which can be used in the silver halide photographic lightsensitive material of the present invention. The photographic performance at $10^{-6}$ sec or less exposure time has not yet been studied partly because the exposure time is in the range not employed in practical photographing and partly because a special exposure device (laser) must be used under ultra-short duration exposure. Further, there is no literature referring to the interrelationship between photographic speed under ultra-short duration exposure and photographic speed under radiation.

BRIEF SUMMARY OF THE INVENTION

It is an object of the present invention to improve the ratio of photographic speed/radiation fog of a silver halide photographic lightsensitive material. More specifically, it is an object of the present invention to provide a silver halide photographic lightsensitive material which realizes a reduction of radiation fog without any significant detriment to the practical photographic speed at usual exposure time (1/100 sec) and the practical reciprocity law ($10^{-5}$ to 10 sec exposure).

The inventor has made extensive and intensive studies. As a result, it has first been found that there is a correlation between the photographic speed under $10^{-6}$ sec or less ultra-short duration exposure and the photographic speed under radiation with respect to tabular grains of large equivalent circle diameter and small grain thickness. Further, it has been found that a lightsensitive material improved with respect to the ratio of photographic speed/radiation fog can be obtained by carrying out, for example, not only reducing of the amount of gold used in after-ripening but also reducing of the amount of Ir in silver halide grains, increasing of the surface iodide content of silver halide grains, lowering of the (100) face proportion to grain side faces, etc. to thereby produce an emulsion exhibiting a large reciprocity low failure under ultra-short duration exposure without detriment to the photographic speed under 1/100 sec exposure and the reciprocity law under $10^{-5}$ to 10 sec exposure. Accordingly, the present invention provides the following silver halide photographic lightsensitive material.

(1) A silver halide photographic lightsensitive material comprising at least one lightsensitive silver halide emulsion layer on a support, wherein the lightsensitive material exhibits a speed at $3\times10^{-9}$ sec exposure time being lower than a speed at $10^{-5}$ sec exposure time by 30 or more in terms of speed unit;

(2) The silver halide photographic lightsensitive material according to item (1) above, wherein the lightsensitive material exhibits a speed at $10^{-5}$ sec exposure time being higher than a speed at 10 sec exposure time by 0 to 60 in terms of speed unit;

(3) The silver halide photographic lightsensitive material according to item (2) above, wherein the lightsensitive material exhibits a speed at $3\times10^{-9}$ sec exposure time being lower than a speed at $10^{-5}$ sec exposure time by 50 or more in terms of speed unit;

(4) The silver halide photographic lightsensitive material according to any of items (1) to (3) above, wherein the at least one lightsensitive silver halide emulsion layer comprises an emulsion containing silver halide grains having a variation coefficient of equivalent circle diameter distribution of all the grains which is in a range of 40 to 3%, and 50% or more of the total projected area of all the silver halide grains is occupied by tabular grains of silver iodobromide or silver iodochlorobromide having (111) faces as main planes, the tabular grains having an equivalent circle diameter of 3.0 $\mu$m or more and a thickness of 0.25 $\mu$m or less;

(5) The silver halide photographic lightsensitive material according to item (4) above, wherein the variation coefficient of equivalent circle diameter distribution of the silver halide grains contained in the emulsion is in a range of 25 to 3%;

(6) The silver halide photographic lightsensitive material according to item (4) or (5) above, wherein 50% or more of the total projected area of all the silver halide grains contained in the emulsion is occupied by tabular grains having an equivalent circle diameter of 3.0 $\mu$m or more and a thickness of 0.15 $\mu$m or less;

(7) The silver halide photographic lightsensitive material according to item (4) or (5) above, wherein 50% or more of the total projected area of all the silver halide grains contained in the emulsion is occupied by tabular grains having an equivalent circle diameter of 4.0 $\mu$m or more and a thickness of 0.15 $\mu$m or less;

(8) The silver halide photographic lightsensitive material according to item (4) or (5) above, wherein 50% or more of the total projected area of all the silver halide grains contained in the emulsion is occupied by tabular grains having an equivalent circle diameter of 4.0 $\mu$m or more and a thickness of 0.10 $\mu$m or less; and (9) The silver halide photographic lightsensitive material according to any of items (1) to (8) above, wherein the lightsensitive material has at least one blue-sensitive layer, at least one green-sensitive layer and at least one red-sensitive layer on the support, and exhibits a speed of ISO 400 or more.

DETAILED DESCRIPTION OF THE INVENTION

The silver halide photographic lightsensitive material of the present invention will now be described. As one preferred embodiment of the lightsensitive material, there is provided a silver halide photographic lightsensitive material which exhibits a speed at $3\times10^{-9}$ sec exposure time being lower than a speed at $10^{-5}$ sec exposure time by 30 or more in terms of speed unit.

The photographic characteristics will be described. The lightsensitive material of the present invention is characterized in that it exhibits a speed at $3\times10^{-9}$ sec exposure time being lower than a speed at $10^{-5}$ sec exposure time by 30 or more, preferably 50 or more, in terms of speed unit. When the speed at $3\times10^{-9}$ sec exposure time is lower than the speed at $10^{-5}$ sec exposure time by less than 30 in terms of speed unit, the radiation fog is extreme to an extent unfavorable in practical use. With respect to the lightsensitive material of the present invention, although the speed at $10^{-5}$ sec exposure time is not limited, it is preferred that the speed at $10^{-5}$ sec exposure time be higher than the speed at 10 sec exposure time by 0 to 60 in terms of speed unit, more preferably, by 0 to 40 in terms of speed unit. When the speed at $10^{-5}$ sec exposure time is higher than the speed at 10 sec exposure time by over 60 in terms of speed unit, the reciprocity low failure is extreme to an extent unfavorable in practical use.

The silver halide photographic lightsensitive material of the invention preferably exhibits an ISO speed of 400 or more, and more preferably an ISO speed of 800 or more.

The speed unit will now be defined. First, the exposure system preferably employed in the determination of speed unit will be described. The exposure system can be varied depending on the exposure time. For example, tungsten sensitometer manufactured by Wakasa Kogaku Kenkyusho can be used when the exposure time is in the range of 10 to 1/100 sec. For example, a sensitometer including xenon flash lamp manufactured by EG & G can be used when the exposure time is in the range of 1/100 to $10^{-5}$ sec. For example, a nanosecond pulse YAG laser can be used when the exposure time is $3\times10^{-9}$ sec. Visible light of variable wavelength can be emitted by the use of this YAG laser in combination with an optical parametric oscillator. The pulse width of the pulse laser is $3\times10^{-9}$ sec.

Now, the wavelength of irradiated light will be described. The wavelength of irradiated light is varied depending on whether the emulsion-containing layer is a blue-sensitive layer, or a green-sensitive layer, or a red-sensitive layer. In the case where light is irradiated to each of the blue-sensitive layer and the green-sensitive layer, preferable light has a wavelength distribution in which a peak thereof is within a range of ±10 nm from each of the wavelength giving a maximum absorption of the blue-sensitive layer and the green sensitive layer, respectively, and in which a half-value width thereof is 60 nm or less. In the case where light is irradiated to the red-sensitive layer, preferable light has a wavelength distribution in which a peak thereof is within a range of ±10 nm from the wavelength giving a maximum absorption of the red sensitive layer, and in which a range thereof spread ±50 nm from the maximum absorption. When a 10 to $10^{-5}$ sec exposure is effected, light of preferred wavelength can be obtained by the use of, for example, a color filter. The blue-sensitive layer and the green-sensitive layer are irradiated with white lights of 5500 K color temperature having been passed through band-pass filters BPB-42 and BPB-53 manufactured by Fuji Photo Film Co., Ltd., respectively. The red-sensitive layer is irradiated with white light of 5500 K color temperature having been passed through sharp cut filter SC-62 and infrared cut filter both manufactured by Fuji Photo Film Co., Ltd. When a $3\times10^{-9}$ sec exposure is effected, monochromatic light of preferred wavelength can be obtained by regulating the oscillation wavelength by means of, for example, an optical parametric oscillator.

Now, the measuring of exposure quantity will be described. The exposure quantity of each of the above tungsten sensitometer, sensitometer using xenon flash lamp and nanosecond pulse YAG laser can be measured by the use of, for example, photometer manufactured by EG & G.

In the development, standard development (development time: 3 min 15 sec) is performed by means of color negative film development processing (CN-16 processing) manufactured by Fuji Photo Film Co., Ltd.

The density is determined by measuring an ISO status M diffusion transmission density. Under the above development conditions, the density exhibited when no exposure is made is referred to as the minimum density, and the greatest density exhibited when the exposure quantity is changed from 0 to infinity is referred to as the maximum density. The speed unit is defined by the formula:

$$(\text{Speed unit})=100\times(\log_{10}H)$$

wherein H represents the exposure quantity required for realizing the density which is the middle of the minimum density and the maximum density.

The radiation fog mentioned in the present invention is an increase of the lowest density after development which is attributed to exposure of the sample to radiation. The radiation mentioned herein is mainly natural radiation, but may be artificially generated radiation. An intentional exposure to radiation can be accomplished by the use of, for example, $^{60}$Co γ-rays. The dose attained by exposure at a distance of 1 m from a radiation source to 37 GBq $^{60}$Co γ-rays for 8 min 10 sec is 0.2 R. The fog increment by radiation can be estimated from the difference between the fog density of the sample having been exposed to radiation and the fog density of the non-exposed sample.

The configuration of silver halide emulsion that can be used in the lightsensitive material of the present invention will be described below.

In the emulsion which can be used in the lightsensitive material of the present invention, 50% or more of the total projected area is occupied by tabular grains of silver iodobromide or silver iodochlorobromide having (111) faces as main planes. Herein, the expression "tabular silver halide grains" is a general term for silver halide grains having one twin face or two or more mutually parallel twin faces. The twin face refers to the (111) face on both sides of which the ions of all the lattice points are in the relationship of reflected images. The tabular grains, as viewed from a point perpendicular to the main plane of the tabular grains, have the shape of a triangle, a hexagon or a circle as obtained by rounding thereof. The triangular, hexagonal and circular tabular grains have mutually parallel main planes which are triangular, hexagonal and circular, respectively.

The twin face spacing of the tabular grains which can be used in the lightsensitive material of the present invention may be 0.012 μm or less as described in U.S. Pat. No. 5,219,720, the disclosure of which is incorporated herewith by reference or may be 15 or more in terms of (111) main plane spacing/twin face spacing as described in JP-A-5-249585, the disclosure of which is incorporated herewith by reference. The twin face spacing can be selected in conformity with the purpose of the use of the tabular grains.

With respect to the emulsion which can be used in the lightsensitive material of the present invention, the projected area of the above tabular grains preferably occupies 100 to 80%, more preferably 100 to 90%, and most preferably 100 to 95%, of the total projected area of all the grains. When the projected area of the tabular grains is less than 50% of the total projected area of all the grains, unfavorably, the advantages (enhancement of ratio of speed/graininess and sharpness) of the tabular grains cannot be fully utilized.

In the emulsion which can be used in the lightsensitive material of the present invention, it is preferred that hexagonal tabular grains whose neighboring side ratio (maximum side length/minimum side length) is in the range of 1.5 to 1 occupy 100 to 50% of the total projected area of all the grains of the emulsion. The above hexagonal tabular grains more preferably occupy 100 to 70%, most preferably 100 to 80%, of the total projected area. In the emulsion which can be used in the lightsensitive material of the present invention, it is especially preferred that hexagonal tabular grains whose neighboring side ratio (maximum side length/minimum side length) is in the range of 1.2 to 1 occupy 100 to 50% of the total projected area of all the grains of the emulsion. The above hexagonal tabular grains more preferably occupy 100 to 70%, most preferably 100 to 80%, of the total projected area. The mixing of tabular grains other than these hexagonal tabular grains into the emulsion is not favorable from the viewpoint of intergranular homogeneity.

In the emulsion which can be used in the lightsensitive material of the present invention, 50% or more of the total projected area of the emulsion is occupied by tabular grains having an equivalent circle diameter of 3.0 μm or more and a thickness of 0.25 μm or less, preferably tabular grains having an equivalent circle diameter of 3.0 μm or more and a thickness of 0.15 μm or less, more preferably tabular grains having an equivalent circle diameter of 4.0 μm or more and a thickness of 0.15 μm or less, and most preferably tabular grains having an equivalent circle diameter of 4.0 μm or more and a thickness of 0.10 μm or less. The emulsion is especially suitable when 80% or more of the total projected area of the emulsion is occupied by tabular grains having an equivalent circle diameter of 3.0 μm or more and a thickness of 0.25 μm or less, preferably tabular grains having an equivalent circle diameter of 3.0 μm or more and a thickness of 0.15 μm or less, more preferably tabular grains having an equivalent circle diameter of 4.0 μm or more and a thickness of 0.15 μm or less, and most preferably tabular grains having an equivalent circle diameter of 4.0 μm or more and a thickness of 0.10 μm or less. When the tabular grains fall outside these ranges, it is unfavorably difficult to realize the effects of the present invention.

In the present invention, the equivalent circle diameter refers to the diameter of a circle having the same area as the projected area of mutually parallel external surfaces of grains.

The projected area of grains can be determined by measuring the grain area on an electron micrograph and effecting a magnification correction thereto. The grain thickness can be easily determined by performing a vapor deposition of metal on grains, together with reference latex, in an oblique direction thereof, measuring the length of grain shadow on an electron micrograph and calculating with reference to the length of the latex shadow.

The average grain thickness of the tabular grains which can be used in the lightsensitive material of the present invention is preferably in the range of 0.03 to 0.25 μm, more preferably 0.05 to 0.15 μm, and most preferably 0.05 to 0.10 μm. The average grain thickness is an arithmetic mean of the thicknesses of all tabular grains contained in the emulsion. It is difficult to prepare an emulsion wherein the average grain thickness is less than 0.03 μm. On the other hand, when the average grain thickness exceeds 0.25 μm, it is unfavorably difficult to realize the advantages of the tabular grains.

The average equivalent circle diameter of the tabular grains which can be used in the lightsensitive material of the present invention is preferably in the range of 3.0 to 6.0 μm, more preferably 3.5 to 5.5 μm, and most preferably 4.0 to 5.5 μm. The average equivalent circle diameter is an arithmetic mean of the equivalent circle diameters of all tabular grains contained in the emulsion. When the average equivalent circle diameter falls outside these ranges, it is unfavorably difficult to realize the effects of the present invention.

The ratio of equivalent circle diameter to thickness with respect to silver halide grains is referred to as "aspect ratio". That is, the aspect ratio is the quotient of the equivalent circle diameter of the projected area of each individual silver halide grain divided by the grain thickness. One method of determining the aspect ratio comprises obtaining a transmission electron micrograph by the replica technique and measuring the diameter of a circle with the same area as the projected area of each individual grain (equivalent circle diameter) and the grain thickness. This grain thickness is calculated from the length of replica shadow.

It is preferred that the emulsion which can be used in the lightsensitive material of the present invention be composed of monodisperse grains. In the present invention, the variation coefficient of grain size (equivalent sphere diameter) distribution of all silver halide grains is preferably in the range of 35 to 3%, more preferably 25 to 3%, and most preferably 20 to 3%. The terminology "variation coefficient of equivalent sphere diameter distribution" used herein means the product obtained by dividing the dispersion (standard deviation) of equivalent sphere diameters of individual tabular grains by the average equivalent sphere diameter and multiplying the resultant quotient by 100. That the variation coefficient of equivalent sphere diameter distribution of all tabular grains exceeds 35% is not favorable from the viewpoint of intergranular homogeneity. On the other hand, it is difficult to prepare an emulsion wherein the variation coefficient is below 3%.

The variation coefficient of equivalent circle diameter distribution of all grains contained in the emulsion which can be used in the lightsensitive material of the present invention is preferably in the range of 40 to 3%, more preferably 25 to 3%, and most preferably 20 to 3%. The terminology "variation coefficient of equivalent circle diameter distribution" used herein means the product obtained by dividing the dispersion (standard deviation) of equivalent circle diameters of individual grains by the average equivalent circle diameter and multiplying the resultant quotient by 100. That the variation coefficient of equivalent circle diameter distribution of all grains exceeds 40% is not favorable from the viewpoint of intergranular homogeneity. On the other hand, it is difficult to prepare an emulsion wherein the variation coefficient is below 3%.

The variation coefficient of grain thickness distribution of all tabular grains contained in the emulsion which can be used in the lightsensitive material of the present invention is preferably in the range of 25 to 3%, more preferably 20 to 3%, and most preferably 15 to 3%. The terminology "variation coefficient of grain thickness distribution" used herein means the product obtained by dividing the dispersion (standard deviation) of grain thicknesses of individual tabular grains by the average grain thickness and multiplying the resultant quotient by 100. That the variation coefficient of grain thickness distribution of all tabular grains exceeds 25% is not favorable from the viewpoint of intergranular homogeneity. On the other hand, it is difficult to prepare an emulsion wherein the variation coefficient is below 3%.

The variation coefficient of twin face spacing distribution of all tabular grains contained in the emulsion which can be used in the lightsensitive material of the present invention is preferably in the range of 25 to 3%, more preferably 20 to 3%, and most preferably 15 to 3%. The terminology "variation coefficient of twin face spacing distribution" used herein means the product obtained by dividing the dispersion (standard deviation) of twin face spacings of individual tabular grains by the average twin face spacing and multiplying the resultant quotient by 100. That the variation coefficient of twin face spacing distribution of all tabular grains exceeds 25% is not favorable from the viewpoint of intergranular homogeneity. On the other hand, it is difficult to prepare an emulsion wherein the variation coefficient is below 3%.

In the present invention, although the grain thickness, aspect ratio and monodispersity can be selected within the above ranges in conformity with the purpose of the use thereof, it is desirable to employ monodisperse tabular grains of small grain thickness and high aspect ratio.

In the present invention, various methods can be employed for the formation of tabular grains of high aspect ratio. For example, the grain forming methods described in U.S. Pat. Nos. 5,496,694 and 5,498,516, the disclosures of which are incorporated herein by reference, can be employed. Further, the grain forming methods described in U.S. Pat. Nos. 5,494,789 and 5,503,970, the disclosures of which are incorporated herein by reference, can be employed for the formation of tabular grains of ultrahigh aspect ratio.

In the production of monodisperse tabular grains of high aspect ratio, it is important to form twinned crystal nuclei of small size within a short period of time. Thus, it is desirable to perform nucleation within a short period of time under low temperature, high pBr, low pH and small gelatin amount conditions. With respect to the type of gelatin, a gelatin of low molecular weight, a gelatin whose methionine content is low or a gelatin whose amino group is modified with, for example, phthalic acid, trimellitic acid or pyromellitic acid and the like are preferably employed.

After the nucleation, physical ripening is performed to thereby eliminate nuclei of regular crystals, single twinned crystals and nonparallel multiple twinned crystals while selectively causing nuclei of parallel double twinned crystals to remain. Further ripening among the remaining nuclei of parallel double twinned crystals is preferable from the viewpoint of enhancing the monodispersity.

Also, it is preferable to perform the physical ripening, for example, in the presence of PAO (polyalkylene oxide) as described in U.S. Pat. No. 5,147,771, the disclosure of which is incorporated herein by reference, from the viewpoint of enhancing the monodispersity.

Thereafter, supplemental gelatin is added, and soluble silver salts and soluble halides are added to thereby effect a grain growth. The above gelatin whose amino group is modified with, for example, phthalic acid, trimellitic acid or pyromellitic acid is preferably employed as the supplemental gelatin.

Further, the grain growth can preferably be performed by adding silver halide fine grains separately prepared in advance or simultaneously prepared in a separate reaction vessel to thereby feed silver and halide.

During the grain growth as well, it is important to control and optimize the temperature of reaction mixture, pH, amount of binder, pBr, feed speed of silver and halide ion, etc.

In the formation of silver halide emulsion grains for use in the present invention, it is preferable to employ silver iodobromide or silver chloroiodobromide. When there is a phase containing an iodide or a chloride, the phase may be uniformly distributed in each grain, or may be localized therein.

Furthermore, other silver salts, such as silver rhodanate, silver sulfide, silver selenide, silver carbonate, silver phosphate and an organic acid salt of silver, may be contained in the form of other separate grains or as parts of silver halide grains.

In the emulsion grains for use in the present invention, the silver bromide content is preferably 80 mol % or more, more preferably 90 mol % or more.

The silver iodide content of the emulsion grains for use in the present invention is preferably in the range of 1 to 20 mol %, more preferably 2 to 15 mol %, and most preferably 3 to 10 mol %. Silver iodide contents of less than 1 mol % are not suitable because it becomes difficult to realize the effects of increasing of dye adsorption, enhancing of intrinsic photographic speed, etc. On the other hand, silver iodide contents of more than 20 mol % are not suitable because the development velocity is generally delayed.

The variation coefficient of intergranular silver iodide content distribution in the emulsion grains for use in the present invention is preferably 30% or less, more preferably 25 to 3%, and most preferably 20 to 3%. That the variation coefficient exceeds 30% is not favorable from the viewpoint of intergranular homogeneity. The terminology "variation coefficient of intergranular silver iodide content distribution" used herein means the product obtained by dividing the standard deviation of silver iodide contents of individual emulsion grains by the average silver iodide content and multiplying the resultant quotient by 100. The silver iodide contents of individual emulsion grains can be measured by analyzing the composition of each individual grain by means of an X-ray microanalyzer.

The measuring method is described in, for example, EP No. 147,868. In the determination of the distribution of silver iodide contents of individual grains contained in the emulsion which can be used in the lightsensitive material of the present invention, the silver iodide contents are preferably measured with respect to at least 100 grains, more preferably at least 200 grains, and most preferably at least 300 grains.

The tabular grains which can be used in the lightsensitive material of the present invention preferably have dislocation lines in the internal part thereof. The methods described in, for example, JP-A's 63-220238, 1-201649 and 6-258745, the disclosures of which are incorporated herein by reference, can preferably be employed in the introduction of dislocation lines in the tabular grains.

The emulsion with the above configuration which can preferably be employed in the lightsensitive material of the present invention that exhibits a speed at $3\times10^{-9}$ sec exposure time being lower than a speed at $10^{-5}$ sec exposure time by 30 or more in terms of speed unit will be described with reference to particular examples. In the present invention, the emulsion can preferably be prepared by, for example, (1) reducing the amount of iridium incorporated in silver halide grains, (2) increasing the surface iodide content, (3) reducing the ratio of (100) faces to grain side faces or (4) reducing the amount of gold added in after-ripening, to which, however, the methods available for the preparation of the emulsion are not limited. The emulsion which can preferably be employed in the lightsensitive material of the present invention, although can be disposed in any of the lightsensitive layers, is preferably disposed in a high-speed layer.

First, the incorporation of iridium in silver halide grains will be described. Water-soluble iridium salts and complex compounds can be mentioned as the iridium compounds which can be used in the present invention. In particular, examples of suitable iridium compounds include iridium trichloride, iridium tetrachloride and di- or penta-sodium, potassium or ammonium hexachloroiridate. With respect to the tabular grains for use in the present invention, it is preferred that the amount of iridium incorporated in the tabular grains be minimized as long as practical failure of the reciprocity law is not caused, from the viewpoint that the reciprocity low failure at ultra-short time exposure is increased. The amount of iridium incorporated in the tabular grains for use in the present invention, although variable depending on the silver halide composition of the tabular grains, the type of metal ion in polynuclear complex or cluster, the oxidation state of the metal ion and the type of ligand in the polynuclear complex or cluster, is preferably $10^{-8}$ mol or less, more preferably in the range of $10^{-10}$ to $10^{-8}$ mol, per mol of silver halide. When the amount of iridium is less than $10^{-10}$ mol per mol of silver halide, the reciprocity low failure at usual exposure time is unfavorably increased. On the other hand, when the amount of iridium exceeds $10^{-8}$ mol per mol of silver halide, the reciprocity low failure at ultra-high illuminance is so small that it is unfavorably difficult to attain the effects of the present invention.

Regarding where to incorporate iridium, iridium can be added to an aqueous solution of gelatin as a dispersant, an aqueous solution of halide, an aqueous solution of silver salt or other aqueous solutions during the formation of silver halide grains. Alternatively, iridium is added in the form of silver halide fine grains containing a polynuclear complex or cluster in advance to the silver halide emulsion, and the incorporation in silver halide grains can be accomplished by, for example, dissolving the emulsion. Although the incorporation of iridium in silver halide grains can be performed at any of stages prior to grain formation, during grain formation and immediately after grain formation, it is preferred that the addition be effected during the grain formation.

In the silver halide grains which can be used in the lightsensitive material of the present invention, it is preferred that 50 mol % or more, especially 80 mol % or more, and most especially 100 mol %, of iridium be localized in the surface layer extending from the surface of each silver halide grain and constituting 50% or less of the grain volume. The volume of this surface layer is preferably 30% or less. The localization of iridium in the surface layer is effective in realizing a high speed while suppressing the increase of internal speed. The localized incorporation of a polynuclear complex or cluster in the surface layer of silver halide grains can be accomplished by, for example, first forming non-surface-layer portions of silver halide grains (core portions) and subsequently adding a solution of water-soluble silver salt and an aqueous solution of halide for forming the surface layer while simultaneously feeding iridium.

Preferred surface iodide content of the emulsion which can be used in the lightsensitive material of the present invention will now be described. From the viewpoint that the reciprocity low failure at ultra-high illuminance can be brought about, it is preferred that the surface iodide content of the emulsion which can be used in the lightsensitive material of the present invention be in the range of 3 to 8 mol %. The surface iodide content is more preferably in the range of 4 to 8 mol %, most preferably 5 to 8 mol %. When the surface iodide content is less than 3 mol %, it is unfavorably difficult to bring about the reciprocity low failure at ultra-high illuminance, thereby rendering exertion of the effects of the present invention difficult. On the other hand, when the surface iodide content exceeds 8 mol %, development inhibition or inhibition of chemical sensitization unfavorably occurs. The measuring of surface iodide content can be performed by the ESCA method (also known as the XPS method, which is the method in which X-rays are irradiated to grains and photoelectrons emitted from the grain surface are spectralized). Practical control of the surface iodide content can be accomplished by, for example, first forming silver halide base grains and subsequently adding a solution of water-soluble silver salt and an aqueous solution of halide for forming a surface shell while regulating the amount of potassium iodide in the aqueous solution of halide.

Below, the face indices of the surface of emulsion grains which can be used in the lightsensitive material of the present invention will be described. The surface of emulsion grains which can be used in the lightsensitive material of the present invention consists mainly of (111) and (100) faces. The ratio of (111) faces to the entire surface with respect to the emulsion grains which can be used in the lightsensitive material of the present invention is at least 70%.

With respect to the (100) faces, these appear on the sides of tabular grains in the emulsion grains which can be used in the lightsensitive material of the present invention. For control of the ratio of (100) faces, reference can be made to, for example, JP-A's 2-298935 and 8-334850, the disclosures of which are incorporated herein by reference. The ratio of (100) faces to the entire surface area of grains can be determined by the method wherein the difference in adsorption dependency between (111) faces and (100) faces with respect to the adsorption of a sensitizing dye is utilized, for example, the method described in T. Tani, J. Imaging Sci., 29, 165 (1985).

The emulsion which can be used in the lightsensitive material of the present invention is occupied by tabular grains whose (100) face areal ratio to the side faces of emulsion grains is preferably in the range of 5 to 35%, more preferably 5 to 25%, and most preferably 5 to 20%. When the areal ratio falls outside these ranges, it is unfavorably difficult to attain the effects of the present invention. The (100) face areal ratio to the side faces of tabular grains can be determined by, for example, the method described in JP-A-8-334850, the disclosure of which is incorporated by reference.

That is, letting Cud be the ratio of the area which (111) faces occupy on the surface of an emulsion grain to the area which (100) faces occupy on the grain surface, an area ratio ECud of (100) faces in side faces of a tabular grain is $$Cud\times(ECD+2t)/2t$$

where ECD: average equivalent circle diameter ($\mu$m) t: average grain thickness ($\mu$m) More specifically, the (100) face ratio is controlled by controlling the pAg, halogen composition, silver halide solvent concentration, and pH during the formation of silver halide grains, or by using a compound represented by formula (I) below:

$$YO(CH_2CH_2O)_m(CH(CH_3)CH_2O)_p(CH_2CH_2O)_nY \quad (I)$$

In formula (I), Y represents a hydrogen atom, —$SO_3M$, or —COBCOOM, M represents a hydrogen atom, an alkali metal atom, an ammonium group, or an alkyl-substituted ammonium group having 5 or less carbon atoms, B represents a chainlike or cyclic group for forming an organic dibasic acid, each of m and n represents an integer of 0 to 50, and p represents an integer of 1 to 100.

Practical examples of the compound represented by formula (I) are set forth below:

I-1

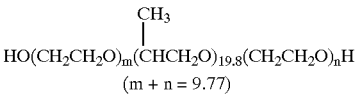

I-2

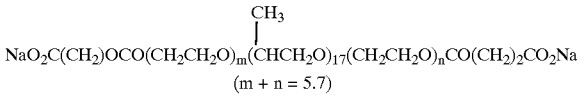

I-3

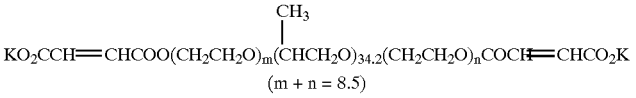

I-4

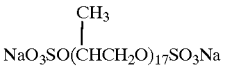

I-5

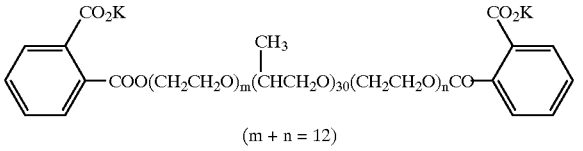

I-6

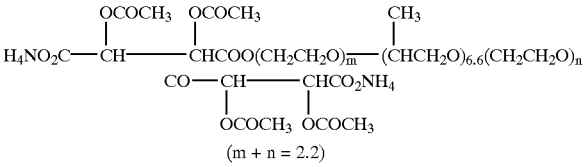

In the present invention, the addition amount of the compound represented by formula (I) is $5\times10^{-2}$ g to 10 g per mole of silver halide.

It is preferable for the silver halide emulsion that can be used in the lightsensitive material of the invention to perform gold and chalcogen sensitizations. The chalcogen sensitization is performed with at least one of a sulfur sensitizer, a selenium sensitizer and a tellurium sensitizer.

The gold sensitization is usually performed by adding a gold sensitizer to the emulsion and stirring the emulsion for a predetermined time at a high temperature, preferably, 40° C. or more.

As the gold sensitizers for the gold sensitization performed in the invention, the oxidation number of gold may be +1 or +3, and any gold compounds that are conventionally used as a gold sensitizer may be used. As representative examples of the gold sensitizer, chloroauric acid, potassium chloroaurate, auricrichloride, potassium auricthiocyanate, potassiumu iodoaurate, tetracyanoauric acid, ammonium aurothiocyanate and pyridyltorichloro gold can be enumerated.

The addition amount of the fold sensitizer is preferably as low as possible as long as a practical sensitivity of the emulsion used in the invention is not greatly impaired, in view of lowering the sensitivity attained with an exposure of ultra-high illuminance. The addition amount of the gold sensitizer, although it may vary depending on the temperature at after-ripening, is preferably $1\times10^{-6}$ mol or less per mole of silver halide, more preferably, $1\times10^{-8}$ to $1\times10^{-6}$ mol per mole of silver halide. It is not preferable to increase the addition amount too large, because reciprocity law failure at ultra-high illuminance becomes too small.

The sulfur sensitization is usually performed by adding a sulfur sensitizer to the emulsion and stirring the emulsion for a predetermined time at a high temperature, preferably 40° C. or more.

For the sulfur sensitization, compounds that are known as a sulfur sensitizer may be used. For example, thiosulfate, allylthiocarbamide urea, allylisothiocyanate, cystine, p-toluenethiosulfonic acid and rhodanine can be emumerated. In addition, the sulfur sensitizes described in the specifications of U.S. Pat. Nos. 1,547,944, 2,410,689, 2,278,947, 2,728,668, 3,501,313, and 3,656,955, and German Patent 1,422,868, and Jpn. Pat. Appln. KOKOKU Publication No. (hereinafter refereed to as JP-B) 56-24937, JP-A-55-45016 may be used. The addition amount of the sulfur sensitizer may be the one sufficient for effectively raise the sensitivity of the emulsion. The amount can be varied over a considerable range under various conditions such as pH, a temperature, and a size of a silver halide grain, but the amount is preferably, $1\times10^{-7}$ to $1\times10^{-4}$ mol per mole of silver halide.

The selenium sensitization can be performed by a conventionally known method. That is, the selenium sensitization is usually performed by adding labile selenium compounds and/or non-labile selenium compounds to the emulsion and stirring it for a predetermined time at a high temperature, preferably 40° C. or more. The selenium sensitization using labile selenium compounds disclosed in JP-B-44-1578 is preferable performed. As specific selenium sensitizers, aliphatic isocyanates sucu as allyisoselenocyanate, selenoureas, selenoketones, selenoamides, selenocarboxylic acids and esters, and selenophosphates are emumerated.

Now, the tellulimu sensitization will be described. As tellulium sensitizers used in the invention, known tellulium sensitizers described in U.S. Pat. Nos. 1,623,499, 3,320,069, and 3,772,031, British Patent Nos. 235,211, 1,121,496, 1,295,462, and 1,396,696, and Canadian Patent No. 800, 958, and JP-A-8-95184, and J. Chem. Soc. Chem. Commun. 635(1980), ibid 1102(1979), and ibid 645(1979), J. Chem. Soc. Perkin Trans. 1, 2191(1980), The chemistry of Organic Selenium and Telllurium compounds, Vol. 1(1986), S. Patai ed., and ibid Vol. 2(1987).

The followings are the description of the emulsions that are specified to be used in the lightsensitive material of the invention and other emulsions that can be used together.

Emulsions that are specified to be used in the lightsensitive material of the invention and other photographic emulsions that can be used together with the emulsions of the present invention can be prepared by the methods described in, e.g., P. Glafkides, Chimie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964. That is, any of an acid method, a neutral method, and an ammonia method can be used. In forming grains by the reaction of a soluble silver salt and a soluble halogen salt, any of the single-jet method, the double-jet method, and the combination of these methods can be used. It is also possible to use a method (so-called reverse double-jet method) of forming grains in the presence of excess silver ion. As one type of the double-jet method, a method in which the pAg of a liquid phase for producing a silver halide is maintained constant, i.e., a so-called controlled double-jet method can be used. This method makes it possible to obtain a silver halide emulsion in which the crystal shape is regular and the grain size is nearly uniform.

In some cases, it is preferable to make use of a method of adding silver halide grains already formed by precipitation to a reactor vessel for emulsion preparation, and the methods described in U.S. Pat. Nos. 4,334,012, 4,301,241, and 4,150,994, the discloses of which are herein incorporated by reference. These silver halide grains can be used as seed crystal and are also effective when supplied as a silver halide for growth. In the latter case, addition of an emulsion with a small grain size is preferable. The total amount of an emulsion can be added at one time, or an emulsion can be separately added a plurality of times or added continuously. In addition, it is sometimes effective to add grains having several different halogen compositions in order to modify the surface.

A method of converting most of or only a part of the halogen composition of a silver halide grain by a halogen conversion process is disclosed in, e.g., U.S. Pat. Nos. 3,477,852 and 4,142,900, European Patents (hereinafter also referred to as EU) 273,429 and 273,430, and West German Patent 3,819,241, the disclosers of which are incorporated herein by reference. This method is an effective grain formation method. To convert into a silver salt that is more sparingly soluble, it is possible to add a solution of a soluble halogen or silver halide grains. The conversion can be performed at one time, separately a plurality of times, or continuously.

As a grain growth method other than the method of adding a soluble silver salt and a halogen salt at a constant concentration and a constant flow rate, it is preferable to use a grain formation method in which the concentration or the flow rate is changed, such as described in British Patent (hereinafter also referred to as GB) 1,469,480 and U.S. Pat. Nos. 3,650,757 and 4,242,445, the disclosures of which are incorporated herein by reference. Increasing the concentration or the flow rate can change the amount of a silver halide to be supplied as a linear function, a quadratic function, or a more complex function of the addition time. It is also preferable to decrease the silver halide amount to be supplied if necessary depending on the situation. Furthermore, when a plurality of soluble silver salts of different solution compositions are to be added, a plurality of soluble halogen salts of different solution compositions are to be added or a method of increasing one of the salts while decreasing the other is also effective.

A mixing vessel for reacting solutions of soluble silver salts and soluble halogen salts can be selected from those described in U.S. Pat. Nos. 2,996,287, 3,342,605, 3,415,650, and 3,785,777 and West German Patents 2,556,885 and 2,555,364, the disclosures of which are incorporated herein by reference.

A silver halide solvent is useful for the purpose of accelerating ripening. As an example, it is known to make an excess of halogen ion exist in a reactor vessel in order to accelerate ripening. Another ripening agent can also be used. The total amount of these ripening agents can be mixed in a dispersing medium placed in a reactor vessel before addition of a silver salt and a halide salt or can be introduced to the reactor vessel simultaneously with addition of a halide salt, a silver salt, and a deflocculant. Alternatively, ripening agents can be independently added in the step of adding a halide salt and a silver salt.

Examples of the ripening agent are ammonia, thiocyanate (e.g., potassium rhodanate and ammonium rhodanate), an organic thioether compound (e.g., compounds described in U.S. Pat. Nos. 3,574,628, 3,021,215, 3,057,724, 3,038,805, 4,276,374, 4,297,439, 3,704,130, and 4,782,013 and JP-A-57-104926), a thione compound (e.g., four-substituted thioureas described in JP-A-53-82408, JP-A-55-77737, and U.S. Pat. No. 4,221,863, and compounds described in JP-A-53-144319), mercapto compounds capable of accelerating growth of silver halide grains, described in JP-A-57-202531, and an amine compound (e.g., JP-A-54-100717).

It is advantageous to use gelatin as a protective colloid for use in the preparation of emulsions of the present invention or as a binder for other hydrophilic colloid layers. However, another hydrophilic colloid can also be used in place of gelatin.

Examples of the hydrophilic colloid are protein such as a gelatin derivative, a graft polymer of gelatin and another high polymer, albumin, and casein; cellulose derivatives such as hydroxyethylcellulose, carboxymethylcellulose, and cellulose sulfates; sugar derivatives such as soda alginate and a starch derivative; and a variety of synthetic hydrophilic high polymers such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole.

Examples of gelatin are lime-processed gelatin, oxidated gelatin, and enzyme-processed gelatin described in Bull. Soc. Sci. Photo. Japan. No. 16, p. 30 (1966). In addition, a hydrolyzed product or an enzyme-decomposed product of gelatin can also be used.

It is preferable to wash with water an emulsion of the present invention to desalt, and disperse into a newly prepared protective colloid. Although the temperature of washing can be selected in accordance with the intended use, it is preferably 5° C. to 50° C. Although the pH of washing can also be selected in accordance with the intended use, it is preferably 2 to 10, and more preferably, 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

It is sometimes useful to perform a method of adding a chalcogen compound during preparation of an emulsion, such as described in U.S. Pat. No. 3,772,031. In addition to S, Se, and Te, cyanate, thiocyanate, selenocyanic acid, carbonate, phosphate, and acetate can be present.

In the formation of silver halide grains of the present invention, at least one of chalcogen sensitization including sulfur sensitization and selenium sensitization, and noble metal sensitization including gold sensitization and palladium sensitization, and reduction sensitization can be performed at any point during the process of manufacturing a silver halide emulsion. The use of two or more different sensitizing methods is preferable. Several different types of emulsions can be prepared by changing the timing at which the chemical sensitization is performed. The emulsion types are classified into: a type in which a chemical sensitization nucleus is embedded inside a grain, a type in which it is embedded in a shallow position from the surface of a grain, and a type in which it is formed on the surface of a grain. In emulsions of the present invention, the position of a chemical sensitization speck can be selected in accordance with the intended use. However, it is preferable to form at least one type of a chemical sensitization nucleus in the vicinity of the surface.

One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

A preferable amount of a palladium compound is $1\times10^{-3}$ to $5\times10^{-7}$ mol per mol of a silver halide. A preferable amount of a thiocyan compound or a selenocyan compound is $5\times10^{-2}$ to $1\times10^{-6}$ mol per mol of a silver halide.

An amount of a sulfur sensitizer with respect to silver halide grains of the present invention is preferably $1\times10^{-4}$ to $1\times10^{-7}$ mol, and more preferably, $1\times10^{-5}$ to $5\times10^{-7}$ mol per mol of a silver halide.

Selenium sensitization is a preferable sensitizing method for emulsions of the present invention. Known labile selenium compounds are used in the selenium sensitization. Practical examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

It is preferable to perform reduction sensitization during grain formation, after grain formation but before chemical sensitization, during chemical sensitization, or after chemical sensitization of the silver halide emulsion.

Reduction sensitization performed in the present invention can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. It is also possible to combine two or more of these methods.

The method of adding reduction sensitizers is preferred in that the level of reduction sensitization can be finely adjusted.

Known examples of the reduction sensitizer are stannous chloride, ascorbic acid and its derivatives, amines and polyamines, hydrazine derivatives, formamidinesulfinic acid, a silane compound, and a borane compound. In reduction sensitization of the present invention, it is possible to selectively use these reduction sensitizers or to use two or more types of compounds together. Preferable compounds as the reduction sensitizer are stannous chloride, thiourea dioxide, dimethylamineborane, and ascorbic acid and its derivatives. Although the addition amount of reduction sensitizers must be so selected as to meet the emulsion manufacturing conditions, a proper amount is $10^{-7}$ to $10^{-2}$ mol per mol of a silver halide.

The reduction sensitizer is, for example, added during grain formation by dissolving thereof to water, or organic solvents such as alcohols, glycols, ketones, esters, and amides. The reduction sensitizer can previously added to a reaction vessel, but it is preferable to add the reduction sensitize at a proper timing during grain growth. It is also possible to previously add the reduction sensitizer to a solution of a water-soluble silver salt or of an alkaline halide, thereby to precipitate silver halide grains using the solutions. It is also preferable to add a solution of the reduction sensitizer at several times separately during the grain growth or add the solution for a consecutive long period.

It is preferable to use an oxidizer for silver during the process of manufacturing emulsions of the present invention. An oxidizer for silver means a compound having an effect of converting metal silver into silver ion. A particularly effective compound is the one that converts very fine silver grains, as a by-product in the process of formation of silver halide grains and chemical sensitization, into silver ion. The silver ion produced can form a silver salt hard to dissolve in water, such as a silver halide, silver sulfide, or silver selenide, or a silver salt easy to dissolve in water, such as silver nitrate. An oxidizer for silver can be either an inorganic or organic substance. Examples of the inorganic oxidizer are ozone, hydrogen peroxide and its adduct (e.g., $NaBO_2 \cdot H_2O_2 \cdot 3H_2O$, $2NaCO_3 \cdot 3H_2O_2$, $Na_4P_2O_7 \cdot 2H_2O_2$, and $2Na_2SO_4 \cdot H_2O_2 \cdot 2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4] \cdot 3H_2O$, $4K_2SO_4 \cdot Ti(O_2)OH \cdot SO_4 \cdot 2H_2O$, and $Na_3[VO(O_2)(C_2H_4)_2\ 6H_2O]$, permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are ozone, hydrogen peroxide and its adduct, a halogen element, an inorganic oxidizer of thiosulfonate, and an organic oxidizer of quinones. The combined use of the aforementioned reduction sensitizer and the oxidizer to silver is a preferable embodiment. The method of adding the oxidizer can be selected from the method of using the oxidizer followed by performing reduction sensitization, the vice versa thereof, or the method of making both of the oxidizer and the reduction sensitizer present at the same time. These methods can be performed at a grain formation step or a chemical sensitization step.

Photographic emulsions used in the present invention can contain various compounds in order to prevent fog during the manufacturing process, storage, or photographic processing of a sensitized material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly hydroxy-substituted(1,3,3a,7)tetrazaindenes), and pentazaindenes. For example, compounds described in U.S. Pat. Nos. 3,954,474 and 3,982,947 and JP-B-52-28660 can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

The photographic emulsion of the present invention is preferably subjected to a spectral sensitization with at least one methine dye or the like, from the viewpoint that the effects desired in the present invention can be exerted. Examples of usable dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. Any of nuclei commonly used in cyanine dyes as basic heterocyclic nuclei can be applied to these dyes. Examples of such applicable nuclei include a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have at least one substituent on carbon atoms thereof.

Any of 5 or 6-membered heterocyclic nuclei such as a pyrazolin-5-one nucleus, a thiohydantoin nucleus, a 2-thioxazolidine-2,4-dione nucleus, a thiazolidine-2,4-dione nucleus, a rhodanine nucleus and a thiobarbituric acid nucleus can be applied as a nucleus having a ketomethylene structure to the merocyanine dye or composite merocyanine dye.

These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, and GB 1,344,281 and 1,507,803, JP-B's-43-4936 and 53-12375 and JP-A's-52-110618 and 52-109925.

The emulsion of the present invention may be doped with a dye which itself exerts no spectral sensitizing effect or a substance which absorbs substantially none of visible radiation and exhibits supersensitization, together with the above spectral sensitizing dye.

The emulsion may be doped with the spectral sensitizing dye at any stage of the process for preparing the emulsion which is known as being useful. Although the doping is most usually conducted at a stage between the completion of the chemical sensitization and before the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization as described in JP-A-58-113928, and also, the spectral sensitizing dye can be added prior to the completion of silver halide grain precipitation to thereby initiate the spectral sensitization. Further, the above compound can be divided prior to addition, that is, part of the compound can be added prior to the chemical sensitization with the rest of the compound added after the chemical sensitization as taught in U.S. Pat. No. 4,225,666. Still further, the spectral sensitizing dye can be added at any stage during the formation of silver halide grains, such as the method disclosed in U.S. Pat. No. 4,183,756 and other methods.

The addition amount of the spectral sensitizing dye can range from $4\times10^{-6}$ to $8\times10^{-3}$ mol per mol of the silver halide. In the case where a preferable silver halide grain size of 0.2 to 1.2 $\mu$m, the addition amount of about $5\times10^{-5}$ to $2\times10^{-3}$ mol is effective.

In the lightsensitive material of the present invention, it is only required that at least one silver halide emulsion layer, preferably, at least three lightsensitive layers each provided with different ranges to each other, be formed on a support. A typical example is a silver halide photographic lightsensitive material having, on its support, at least one lightsensitive layer constituted by a plurality of silver halide emulsion layers which are sensitive to essentially the same color but have different sensitivities. This lightsensitive layer includes a unit lightsensitive layer which is sensitive to one of blue light, green light and red light. In a multilayered silver halide color photographic lightsensitive material, these unit lightsensitive layers are generally arranged in the order of red-, green- and blue-sensitive layers from a support. However, according to the intended use, this arrangement order may be reversed, or lightsensitive layers sensitive to the same color can sandwich another lightsensitive layer sensitive to a different color.

At least one non lightsensitive layer can be formed between the silver halide lightsensitive layers and as the uppermost layer and the lowermost layer. These intermediate layers may contain, e.g., couplers to be described later, DIR compounds and color-mixing inhibitors. As for a plurality of silver halide emulsion layers constituting respective unit lightsensitive layer, a two-layered structure of high- and low-speed emulsion layers can be preferably used in this order so as to the speed becomes lower toward the support as described in DE (German Patent) 1,121,470 or GB 923,045, the disclosures of which are incorporated herein by reference. Also, as described in JP-A's-57-112751, 62-200350, 62-206541 and 62-206543, the disclosures of which are incorporated herein by reference, layers can be arranged such that a low-speed emulsion layer is formed farther from a support and a high-speed layer is formed closer to the support.

As described in JP-B-49-15495, the disclosure of which is incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464, the disclosure of which is incorporated herein by reference. In addition, the order of high-speed emulsion layer/low-speed emulsion layer/medium-speed emulsion layer or the order of low-speed emulsion layer/medium-speed emulsion layer/high-speed emulsion layer can be adopted. Furthermore, the arrangement can be changed as described above even when four or more layers are formed.

In addition, the lightsensitive material of the invention may have a emulsion layer having a fourth or more color sensitivities.

The layers of the fourth or more color sensitivities may be a layer that is sensitive to a wavelength region partially different from those of the blue-sensitive, green-sensitive, and red-sensitive layers. The fourth or more layers may be sensitive to infrared light or ultraviolet light. The coupler used therein can be selected depending on the purpose thereof.

When the lightsensitive material have unit layers each comprising three-layer structure, the layer structure of the lightsensitive material of the invention are enumerated as follows, however, the present invention is not limited to these. The order of the layer arrangement is from the layer nearer to the support.

1) low-speed red-sensitive emulsion layer (RLu), medium-speed red-sensitive emulsion layer (RLm), high-speed red-sensitive emulsion layer (RLo), low-speed green-sensitive emulsion layer (GLu), medium-speed green-sensitive emulsion layer (GLm), high-speed green-sensitive emulsion layer (GLo), low-speed blue-sensitive emulsion layer (BLu), medium-speed blue-sensitive emulsion layer (BLm), high-speed blue-sensitive emulsion layer (BLo);

2) GLu, GLm, GLo, RLu, RLm, RLo, BLu, BLm, BLo;

3) GLu, RLu, GLm, RLm, GLo, RLo, BLu, BLm, BLo;

4) GLu, GLm, RLu, RLm, GLo, RLo, BLu, BLm, BLo;

5) RLu, RLm, GLu, GLm, GLo, RLo, BLu, BLm, BLo;

6) GLu, RLu, RLm, GLm, GLo, RLo, BLu, BLm, BLo;

7) RLu, GLu, RLm, GLm, GLo, RLo, BLu, BLm, BLo;

8) GLu, GLm, RLm, GLm, RLo, GLo, BLu, BLm, BLo;

9) RLu, RLm, GLu, GLm, RLo, GLo, BLu, BLm, BLo;

10) GLu, GLm, RLu, RLm, RLo, GLo, BLu, BLm, BLo;

11) RLu, GLu, GLm, RLu, RLo, GLo, BLu, BLm, BLo;

12) GLu, RLu, GLm RLm, RLo, GLo, BLu, BLm, BLo.

Silver halide photographic lightsensitive material to which the present invention can be applied may contain various additives in accordance with its purposes.

These additives are described in detail in Research Disclosure Item 17643 (December 1978), Item 18716 (November 1979) and Item 308119 (December 1989), the disclosures of which are incorporated herein by reference. A summary of the locations where they are described will be listed in the following table.

| | Types of additives | RD17643 | RD18716 | RD308119 |
|---|---|---|---|---|
| 1 | Chemical-sensitizers | page 23 | page 648 right column | page 996 |
| 2 | Sensitivity increasing agents | | page 648 right column | |
| 3 | Spectral sensitizers, super-sensitizers | pages 23–24 | page 648, right column to page 649, right column | page 996, right column to page 998, right column |
| 4 | Brighteners | page 24 | | page 998 right column |
| 5 | Antifoggants, and stabilizers | pages 24–25 | page 649 right column | page 998, right column to page 1000, right column |
| 6 | Light absorbents, filter dyes, ultraviolet absorbents | pages 25–26 | page 649, right column to page 650, left column | page 1003, left column to page 1003, right column |
| 7 | Stain preventing agents | page 25, right column | page 650, left to right columns | page 1002, right column |
| 8 | Dye image stabilizers | page 25 | | page 1002, right column |
| 9 | Film hardeners | page 26 | page 651, left column | page 1004, right column to page 1005, left column |
| 10 | Binders | page 26 | page 651, left column | page 1003, right column to page 1004, right column |
| 11 | Plasticizers, lubricants | page 27 | page 650, right column | page 1006, left to right columns |
| 12 | Coating aids, surfactants | pages 26–27 | page 650, right column | page 1005, left column to page 1006, left column |
| 13 | Antistatic agents | page 27 | page 650, right column | page 1006, right column to page 1007, left column |
| 14 | Matting agents | | | page 1008, left column to page 1009, left column. |

With respect to the layer arrangement and related techniques, silver halide emulsions, dye forming couplers, DIR couplers and other functional couplers, various additives and development processing which can be used in the photographic lightsensitive material of the present invention and the emulsions suitable for use in the lightsensitive material, reference can be made to EP 0565096A1 (published on Oct. 13, 1993), the disclosure of which is incorporated herein by reference, and patents cited therein. Individual particulars and the locations where they are described will be listed below.

1. Layer arrangement: page 61 lines 23 to 35, page 61 line 41 to page 62 line 14,
2. Interlayers: page 61 lines 36 to 40,
3. Interlayer effect imparting layers: page 62 lines 15 to 18,
4. Silver halide halogen compositions: page 62 lines 21 to 25,
5. Silver halide grain crystal habits: page 62 lines 26 to 30,
6. Silver halide grain sizes: page 62 lines 31 to 34,
7. Emulsion production methods: page 62 lines 35 to 40,
8. Silver halide grain size distributions: page 62 lines 41 to 42,
9. Tabular grains: page 62 lines 43 to 46,
10. Internal structures of grains: page 62 lines 47 to 53,
11. Latent image forming types of emulsions: page 62 line 54 to page 63 to line 5,
12. Physical ripening and chemical sensitization of emulsion: page 63 lines 6 to 9,
13. Emulsion mixing: page 63 lines 10 to 13,
14. Fogging emulsions: page 63 lines 14 to 31,
15. Nonlightsensitive emulsions: page 63 lines 32 to 43,
16. Silver coating amounts: page 63 lines 49 to 50,
17. Photographic additives usable in the present invention are also described in RD, Item 17643 (December, 1978), Item 18716 (November, 1979) and Item 307105 (November, 1989) and the relevant description portions are summarized in the following table.

| | Types of Additives | RD17643 | RD18716 | RD307105 |
|---|---|---|---|---|
| (1) | Chemical sensitizers | page 23 | page 648 right column | page 866 |
| (2) | Sensitivity increasing agents | | page 648 right column | |
| (3) | Spectral sensitizers, super sensitizers | pages 23–24 | page 648, right column to page 649, right column | pages 866–868 |
| (4) | Brighteners | page 24 | page 647, right column | page 868 |
| (5) | Antifoggants and stabilizers | pages 24–25 | page 649, right column | pages 868–870 |
| (6) | Light absorbents, filter dyes, | pages 25–26 | page 649, right column to page 650, | page 873 |

-continued

| | Types of Additives | RD17643 | RD18716 | RD307105 |
|---|---|---|---|---|
| | ultraviolet absorbents | | left column | |
| (7) | Stain preventing agent | page 25, right column | page 650, left column to right column | page 872 |
| (8) | Dye image stabilizers | page 25 | page 650, left column | page 872 |
| (9) | Film hardness | page 26 | page 651, left column | pages 874–875 |
| (10) | Binders | page 26 | page 651, left column | pages 873–874 |
| (11) | Plasticizers, lubricants | page 27 | page 650, right column | page 876 |
| (12) | Coating aids, surfactants | pages 26–27 | page 650, right column | pages 875–876 |
| (13) | Antistatic agents | page 27 | page 650, right column | pages 876–877 |
| (14) | Matting agents | | | pages 878–879. |

18. Formaldehyde scavengers: page 64 lines 54 to 57,
19. Mercapto antifoggants: page 65 lines 1 to 2,
20. Fogging agent, etc.-releasing agents: page 65 lines 3 to 7,
21. Dyes: page 65, lines 7 to 10,
22. Color coupler summary: page 65 lines 11 to 13,
23. Yellow, magenta and cyan couplers: page 65 lines 14 to 25,
24. Polymer couplers: page 65 lines 26 to 28,
25. Diffusive dye-forming couplers: page 65 lines 29 to 31,
26. Colored couplers: page 65 lines 32 to 38,
27. Functional coupler summary: page 65 lines 39 to 44,
28. Bleaching accelerator-releasing couplers: page 65 lines 45 to 48,
29. Development accelerator-releasing couplers: page 65 lines 49 to 53,
30. Other DIR couplers: page 65 line 54 to page 66 to line 4,
31. Method of dispersing couplers: page 66 lines 5 to 28,
32. Antiseptic and mildewproofing agents: page 66 lines 29 to 33,
33. Types of sensitive materials: page 66 lines 34 to 36,
34. Thickness of lightsensitive layer and swelling speed: page 66 line 40 to page 67 line 1,
35. Back layers: page 67 lines 3 to 8,
36. Development processing summary: page 67 lines 9 to 11,
37. Developers and developing agents: page 67 lines 12 to 30,
38. Developer additives: page 67 lines 31 to 44,
39. Reversal processing: page 67 lines 45 to 56,
40. Processing solution open ratio: page 67 line 57 to page 68 line 12,
41. Development time: page 68 lines 13 to 15,
42. Bleach-fix, bleaching and fixing: page 68 line 16 to page 69 line 31,
43. Automatic processor: page 69 lines 32 to 40,
44. Washing, rinse and stabilization: page 69 line 41 to page 70 line 18,
45. Processing solution replenishment and recycling: page 70 lines 19 to 23,
46. Developing agent built-in sensitive material: page 70 lines 24 to 33,
47. Development processing temperature: page 70 lines 34 to 38, and
48. Application to film with lens: page 70 lines 39 to 41.

EXAMPLES

Examples of the present invention will be set forth below, however the present invention is not limited to the examples.

Gelatin-1 to gelatin-4 used as dispersion media in emulsion preparations described below have the following attributes.

Gelatin-1: Conventional alkali-processed ossein gelatin made from bovine bones. No —$NH_2$ group in the gelatin was chemically modified.

Gelatin-2: Gelatin formed by adding phthalic anhydride to an aqueous solution of gelatin-1 at 50° C. and pH 9.0 to cause chemical reaction, removing the residual phthalic acid, and drying the resultant material. The ratio of the number of chemically modified —$NH_2$ groups in the gelatin was 95%.

Gelatin-3: Gelatin formed by adding trimellitic anhydride to an aqueous solution of gelatin-1 at 50° C. and pH 9.0 to cause chemical reaction, removing the residual trimellitic acid, and drying the resultant material. The ratio of the number of chemically modified —$NH_2$ groups in the gelatin was 95%.

Gelatin-4: Gelatin formed by decreasing the molecular weight of gelatin-1 by allowing enzyme to act on it such that the average molecular weight was 15,000, deactivating the enzyme, and drying the resultant material. No —$NH_2$ group in the gelatin was chemically modified.

All of gelatin-1 to gelatin-4 described above were deionized and so adjusted that the pH of an aqueous 5% solution at 35° C. was 6.0.

(Preparation of Emulsions)

Emulsion 1-A 1,300 mL of an aqueous solution containing 0.5 g of KBr and 1.1 g of gelatin-4 described above was stirred at 35° C. (1st solution preparation). 35 mL of an aqueous solution Ag-1 (containing 4.9 g of $AgNO_3$ in 100 mL), 27 mL of an aqueous solution X-1 (containing 5.2 g of KBr in 100 mL), and 8.5 mL of an aqueous solution G-1 (containing 8.0 g of gelatin-4 described above in 100 mL) were added over 30 sec at fixed flow rates by a triple jet method (addition 1). After that, 6.5 g of KBr were added, and the temperature was raised to 75° C. After a ripening step was performed for 20 min, 300 mL of an aqueous solution G-2 (containing 12.7 g of gelatin-3 described above in 100 mL) and 2.10 mL of a 10% methanol solution of $HO(CH_2CH_2O)_m(CH(CH_3)CH_2O)_{19.8}(CH_2CH_2O)_nH$ (m+n=9.77) were added.

Next, 157 mL of an aqueous solution Ag-2 (containing 22.1 g of $AgNO_3$ in 100 mL) and an aqueous solution X-2 (containing 15.5 g of KBr in 100 mL) were added over 14 min by a double jet method. The flow rate of the aqueous solution Ag-2 during the addition was accelerated such that the final flow rate was 2.5 times the initial flow rate. Also, the aqueous solution X-2 was so added that the pAg of the bulk emulsion solution in the reaction vessel was held at 8.0 (addition 2). Subsequently, 329 mL of an aqueous solution Ag-3 (containing 32.0 g of $AgNO_3$ in 100 mL) and an aqueous solution X-3 (containing 21.5 g of KBr and 0.9 g of KI in 100 mL) were added over 27 min by a double jet method. The flow rate of the aqueous solution Ag-3 during the addition was accelerated such that the final flow rate was 1.3 times the initial flow rate. Also, the aqueous solution X-3 was so added that the pAg of the bulk emulsion solution in the reaction vessel was held at 8.0 (addition 3). Furthermore, 156 mL of an aqueous solution Ag-4 (containing 32.0 g of $AgNO_3$ in 100 mL) and an aqueous solution X-4 (containing 22.4 g of KBr in 100 mL) were added over 17 min by a double jet method. The addition of the aqueous solution Ag-4 was performed at a fixed flow rate. The addition of the aqueous solution X-4 was so performed that the pAg of the bulk emulsion solution in the reaction vessel was held at 7.7

(addition 4). After that, 125 mL of an aqueous solution G-3 (containing 12.0 g of gelatin-1 described above in 100 mL) was added.

After the temperature was decreased to 40° C., an aqueous solution containing 0.040 mole of sodium p-iodoasetoamidebenzensulfonate, which is an iodide ion-releasing agent, was added, then 60 mL of a 0.8 M aqueous solution of sodium sulfite was added over 1 min at a fixed rate, and the iodide ions were caused to generate while pH is controlled to 9.0. Two minutes after that the temperature was raised to 55° C. over 15 min, then pH was reduced to 5.5 (addition 5). One minute after that, sodium benzenethiosulfonate and $K_2IrCl_6$ were added in a form of a solution in an amount of $2\times10^{-6}$ mol/mol Ag and $2\times10^{-7}$ mol/mol Ag, respectively. One minute after that, 249 mL of the aqueous solution Ag-4 and the aqueous solution X-5 (containing 22.4 g of KBr in 100 mL) were added by a double jet method over 10 min. The addition of the aqueous solution Ag-4 was performed at a fixed flow rate. The addition of the aqueous solution X-5 was performed such that the pAg of the bulk emulsion solution in the reaction vessel was held at 7.4, and the final pAg was adjusted to 7.8 (addition 6). After that, desalting was performed by normal flocculation. Water, NaOH, and gelatin-1 described above were added under stirring, and the pH and the pAg were adjusted to 6.4 and 8.6, respectively, at 56° C.

The thus obtained emulsion was occupied by silver bromide tabular grains whose parallel main planes ware (111) planes, in an amount of 99% or more of the total projected area.

Subsequently, sensitizing dyes Exs-1 to Exs-3 set forth below, and potassium thiocyanate were added, then chloroauric acid in a form of a solution was added in an amount of $3\times10^{-6}$ mol/mol Ag. Then, sodium thiosulfate and N,N-dimethylselenourea were subsequently added, thereby optimum chemical sensitization was performed within a range that can be prepared with the amounts of these compounds. After that, water-soluble mercapto compounds MER-1 and MER-2 set forth below were added at a ratio of 4:1 such that the total amount was $3.6\times10^{-4}$ mol per mol of a silver halide, to terminate a chemical sensitization (chemical sensitization). Optimal chemical sensitization herein means the maximum sensitivity is obtained by exposure to light for 1/100 sec.

Spectral sensitizing dye Exs-1 for the red-sensitive emulsion

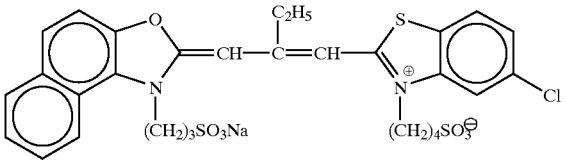

Spectral sensitizing dye Exs-2 for the red-sensitive emulsion

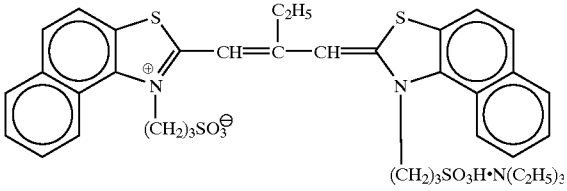

-continued

Spectral sensitizing dye Exs-3 for the red-sensitive emulsion

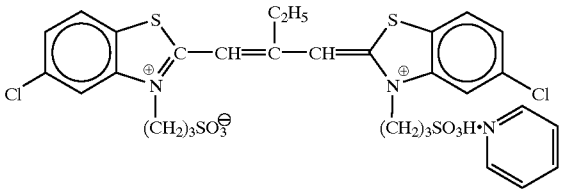

Spectral sensitizing dyes used for the red-sensitive emulsion are a mixt ure of Exs-1, Exs-2 and Exs-3 in a molar ratio of 40:2:58

MER-1

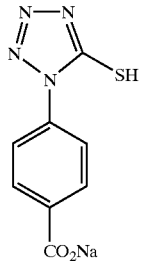

MER-2

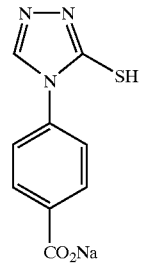

Emulsion 1-B

This emulsion was prepared in the same manner as the emulsion 1-A, except that, at (addition 6) for the emulsion 1-A, $K_2IrCl_6$ was added in the form of a solution in an amount of $8\times10^{-8}$ mol/mol silver in place of the addition in the form of a solution in an amount of $2\times10^{-7}$ mol/mol silver.

Emulsion 1-C

This emulsion was prepared in the same manner as the emulsion 1-B, except for the following changes. At (addition 3), the amount of KI contained in the aqueous solution X-3 was increased from 0.9 g to 1.5 g. At (addition 4), 0.7 g of KI was added to the aqueous solution X-4. At (chemical sensitization), chloroauric acid was added in the form of a solution in an amount of $1\times10^{-6}$ mol/mol silver in place of the addition in the form of a solution in an amount of $3\times10^{-6}$ mol/mol silver, and the amounts of sodium thiosulfate and N,N-dimethylselenourea were regulated so as to carry out the optimum chemical sensitization.

Emulsion 1-D

This emulsion was prepared in the same manner as the emulsion 1-C, except for the following changes. Prior to (addition 2), $HO(CH_2CH_2O)_m(CH(CH_3)CH_2O)_{19.8}(CH_2CH_2O)_nH$ (m+n=9.77) was not added. Thereafter, at (addition 6), the pAg was maintained at 8.0 in place of 7.4.

Emulsion 1-E

This emulsion was prepared in the same manner as the emulsion 1-D, except for the following changes. At (addition 6), $K_2IrCl_6$ was not added. At (chemical sensitization), chloroauric acid was not added.

Emulsions 1-F to 1-Z and 1-AA to 1-AD

Tabular grain emulsions 1-F to 1-Z and 1-AA to 1-AD were prepared by preparing base grain emulsions which are different from each other in equivalent circle diameter and thickness in the same manner as the emulsion 1-A, except that grain formation conditions in (preparation of 1st solution) and (addition 1) to (addition 4) were changed. Specifically, the changes from (addition 1) to (addition 4) were made with respect to pAg, addition rate, type and amount of gelatin, and supply of silver and halide by continuous addition, to the reaction vessel, of silver halide ultra-fine grains (AgBrI having 2 mol % AgI content, and grain size: approximately 150 Å) simultaneously prepared by means of a separate agitator outside the reaction vessel. Thereafter, the following step of (addition 5) was performed in the following manner.

In the preparation of emulsions 1-F, 1-K, 1-P and 1-U, the (addition 5) and subsequent steps were performed in the same manner as in the preparation of the emulsion 1-A.

In the preparation of emulsions 1-G, 1-L, 1-Q and 1-V, the (addition 5) and subsequent steps were performed in the same manner as in the preparation of the emulsion 1-B.

In the preparation of emulsions 1-H, 1-M, 1-R and 1-W, at (addition 3), the amount of KI contained in the aqueous solution X-3 was changed from 0.9 g to 1.5 g. At (addition 4), 0.7 g of KI was added to the aqueous solution X-4. The (addition 5) and subsequent steps were performed in the same manner as in the preparation of the emulsion 1-C.

In the preparation of emulsions 1-I, 1-N, 1-S and 1-X, prior to (addition 2), $HO(CH_2CH_2O)_m(CH(CH_3)CH_2O)_{19.8}(CH_2CH_2O)_nH$ (m+n=9.77) was not added. The (addition 5) and subsequent steps were performed in the same manner as in the preparation of the emulsion 1-D.

In the preparation of emulsions 1-J, 1-O, 1-T and 1-AD, the (addition 5) and subsequent steps were performed in the same manner as in the preparation of the emulsion 1-E.

Emulsion 1-Y was prepared in the same manner as the emulsion 1-X, except that, at (addition 6), $K_2IrCl_6$ was added in the form of a solution in an amount of $9\times10^{-8}$ mol/mol silver in place of the addition in the form of a solution in an amount of $8\times10^{-8}$ mol/mol silver, and at (chemical sensitization), chloroauric acid was added in the form of a solution in an amount of $2\times10^{-6}$ mol/mol silver in place of the addition in the form of a solution in an amount of $1\times10^{-6}$ mol/mol silver.

Emulsion 1-Z was prepared in the same manner as the emulsion 1-Y, except that, at (addition 6), $K_2IrCl_6$ was added in the form of a solution in an amount of $2\times10^{-9}$ mol/mol silver in place of the addition in the form of a solution in an amount of $9\times10^{-8}$ mol/mol silver.

Emulsion 1-AA was prepared in the same manner as the emulsion 1-Z, except that, at (addition 6), $K_2IrCl_6$ was added in the form of a solution in an amount of $5\times10^{-10}$ mol/mol silver in place of the addition in the form of a solution in an amount of $2\times10^{-9}$ mol/mol silver.

Emulsion 1-AB was prepared in the same manner as the emulsion 1-AA, except that, at (chemical sensitization), chloroauric acid was added in the form of a solution in an amount of $6\times10^{-7}$ mol/mol silver in place of the addition in the form of a solution in an amount of $2\times10^{-6}$ mol/mol silver.

Emulsion 1-AC was prepared in the same manner as the emulsion 1-AB, except that, at (chemical sensitization), chloroauric acid was added in the form of a solution in an amount of $2\times10^{-7}$ mol/mol silver in place of the addition in the form of a solution in an amount of $6\times10^{-7}$ mol/mol silver.

In the preparation of these emulsions, the addition rates of the aqueous solutions of silver nitrate and the aqueous solutions of halide were appropriately controlled so as to conform to the critical growth rate of silver halide grains while avoiding re-nucleation and polydispersion by Ostwald ripening.

The grain characteristics of obtained emulsions 1-A to 1-Z and 1-AA to 1-AD are listed in Table 1.

The configuration of grains contained in the emulsions were determined by taking a transmission electron micrograph according to the replica method and effecting measurement as to 1000 grains. With respect to all the emulsions, the variation coefficient of equivalent circle diameter distribution of all grains was 40% or less without exception.

The surface iodide content was measured by XPS. In the measurement by XPS, use was made of ESCA-750 manufactured by Shimadzu Corporation. Mg-Kα (acceleration voltage: 8 KeV and current: 30 mA) was used as excitation X-rays, and peak areas corresponding to I-3d5/2 and Ag-3d5/2 were measured. Intensity ratio was determined, and the average silver iodide content at the surface part of silver halide grains was determined from the intensity ratio.

The (100) face areal ratio to the side faces of tabular grains was determined by the method described in the descriptive portion herein and in JP-A-8-334850, the disclosure of which is incorporated herein by reference.

(The emulsion grain characteristics of the following Examples were also measured in the above manners.)

TABLE 1

| Emulsion | Average equivalent circle diameter of tabular grains (Av.Dc) (μm) | Average grain thickness of tabular grains (Av.th) (μm) | Shape of grains that occupy 50% or more of the total projected area | Addition amount of Ir (mol/mol Ag) | Addition amount of aurichloric acid (mol/mol Ag) | Surface iodide content (mol %) | Ratio of (100) face to grain side faces (%) |
|---|---|---|---|---|---|---|---|
| 1-A | 2.74 | 0.300 | other than Dc ≧ 3.0 μm and th ≦ 0.25 μm | $2\times10^{-7}$ | $3\times10^{-6}$ | 3 | 45 |
| 1-B | 2.74 | 0.300 | other than Dc ≧ 3.0 μm and th ≦ 0.25 μm | $8\times10^{-8}$ | $3\times10^{-6}$ | 3 | 45 |
| 1-C | 2.74 | 0.300 | other than Dc ≧ 3.0 μm and th ≦ 0.25 μm | $8\times10^{-8}$ | $1\times10^{-6}$ | 7 | 45 |
| 1-D | 2.74 | 0.300 | other than Dc ≧ 3.0 μm and th ≦ 0.25 μm | $8\times10^{-8}$ | $1\times10^{-6}$ | 7 | 24 |
| 1-E | 2.74 | 0.300 | other than Dc ≧ 3.0 μm and th ≦ 0.25 μm | 0 | 0 | 7 | 24 |
| 1-F | 3.09 | 0.236 | Dc ≧ 3.0 μm and th ≦ 0.25 μm | $2\times10^{-7}$ | $3\times10^{-6}$ | 3 | 43 |

TABLE 1-continued

| Emulsion | Average equivalent circle diameter of tabular grains (Av.Dc) (μm) | Average grain thickness of tabular grains (Av.th) (μm) | Shape of grains that occupy 50% or more of the total projected area | Addition amount of Ir (mol/mol Ag) | Addition amount of aurichloric acid (mol/mol Ag) | Surface iodide content (mol %) | Ratio of (100) face to grain side faces (%) |
|---|---|---|---|---|---|---|---|
| 1-G | 3.09 | 0.236 | Dc ≧ 3.0 μm and th ≦ 0.25 μm | $8 \times 10^{-8}$ | $3 \times 10^{-6}$ | 3 | 43 |
| 1-H | 3.09 | 0.236 | Dc ≧ 3.0 μm and th ≦ 0.25 μm | $8 \times 10^{-8}$ | $1 \times 10^{-6}$ | 7 | 43 |
| 1-I | 3.09 | 0.236 | Dc ≧ 3.0 μm and th ≦ 0.25 μm | $8 \times 10^{-8}$ | $1 \times 10^{-6}$ | 7 | 21 |
| 1-J | 3.09 | 0.236 | Dc ≧ 3.0 μm and th ≦ 0.25 μm | 0 | 0 | 7 | 21 |
| 1-K | 3.91 | 0.147 | Dc ≧ 3.0 μm and th ≦ 0.15 μm | $2 \times 10^{-7}$ | $3 \times 10^{-6}$ | 3 | 42 |
| 1-L | 3.91 | 0.147 | Dc ≧ 3.0 μm and th ≦ 0.15 μm | $8 \times 10^{-8}$ | $3 \times 10^{-6}$ | 3 | 42 |
| 1-M | 3.91 | 0.147 | Dc ≧ 3.0 μm and th ≦ 0.15 μm | $8 \times 10^{-8}$ | $1 \times 10^{-6}$ | 7 | 42 |
| 1-N | 3.91 | 0.147 | Dc ≧ 3.0 μm and th ≦ 0.15 μm | $8 \times 10^{-8}$ | $1 \times 10^{-6}$ | 7 | 19 |
| 1-O | 3.91 | 0.147 | Dc ≧ 3.0 μm and th ≦ 0.15 μm | 0 | 0 | 7 | 19 |
| 1-P | 4.13 | 0.132 | Dc ≧ 4.0 μm and th ≦ 0.15 μm | $2 \times 10^{-7}$ | $3 \times 10^{-6}$ | 3 | 41 |
| 1-Q | 4.13 | 0.132 | Dc ≧ 4.0 μm and th ≦ 0.15 μm | $8 \times 10^{-8}$ | $3 \times 10^{-6}$ | 3 | 41 |
| 1-R | 4.13 | 0.132 | Dc ≧ 4.0 μm and th ≦ 0.15 μm | $8 \times 10^{-8}$ | $1 \times 10^{-6}$ | 7 | 41 |
| 1-S | 4.13 | 0.132 | Dc ≧ 4.0 μm and th ≦ 0.15 μm | $8 \times 10^{-8}$ | $1 \times 10^{-6}$ | 7 | 18 |
| 1-T | 4.13 | 0.132 | Dc ≧ 4.0 μm and th ≦ 0.15 μm | 0 | 0 | 7 | 18 |
| 1-U | 4.77 | 0.099 | Dc ≧ 4.0 μm and th ≦ 0.10 μm | $2 \times 10^{-7}$ | $3 \times 10^{-6}$ | 3 | 40 |
| 1-V | 4.77 | 0.099 | Dc ≧ 4.0 μm and th ≦ 0.10 μm | $8 \times 10^{-8}$ | $3 \times 10^{-6}$ | 3 | 40 |
| 1-W | 4.77 | 0.099 | Dc ≧ 4.0 μm and th ≦ 0.10 μm | $8 \times 10^{-8}$ | $1 \times 10^{-6}$ | 7 | 40 |
| 1-X | 4.77 | 0.099 | Dc ≧ 4.0 μm and th ≦ 0.10 μm | $8 \times 10^{-8}$ | $1 \times 10^{-6}$ | 7 | 17 |
| 1-Y | 4.77 | 0.099 | Dc ≧ 4.0 μm and th ≦ 0.10 μm | $9 \times 10^{-8}$ | $2 \times 10^{-6}$ | 7 | 17 |
| 1-Z | 4.77 | 0.099 | Dc ≧ 4.0 μm and th ≦ 0.10 μm | $2 \times 10^{-9}$ | $2 \times 10^{-6}$ | 7 | 17 |
| 1-AA | 4.77 | 0.099 | Dc ≧ 4.0 μm and th ≦ 0.10 μm | $5 \times 10^{-10}$ | $2 \times 10^{-6}$ | 7 | 17 |
| 1-AB | 4.77 | 0.099 | Dc ≧ 4.0 μm and th ≦ 0.10 μm | $5 \times 10^{-10}$ | $6 \times 10^{-7}$ | 7 | 17 |
| 1-AC | 4.77 | 0.099 | Dc ≧ 4.0 μm and th ≦ 0.10 μm | $5 \times 10^{-10}$ | $2 \times 10^{-7}$ | 7 | 17 |
| 1-AD | 4.77 | 0.099 | Dc ≧ 4.0 μm and th ≦ 0.10 μm | 0 | 0 | 7 | 17 |

(Preparation of coated samples and evaluations thereof)

A cellulose triacetate film support having an undercoat layer was coated with the emulsions 1-A to 1-Z and 1-AA to 1-AD under the coating conditions as shown in Table 2 below:

Table 2 Emulsion coating conditions (1) Emulsion layer

Emulsions Various emulsions (Silver $1.63 \times 10^{-2}$ mol/m$^2$)

Coupler ($2.26 \times 10^{-3}$ mol/m$^2$)

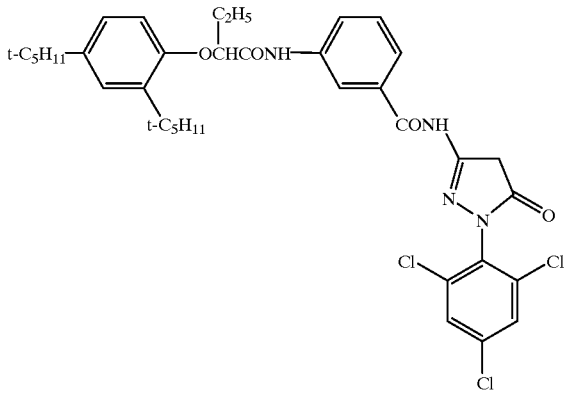

Tricresylphosphate (1.32 g/m$^2$)

Gelatin (3.24 g/m$^2$)

(2) Protective layer 2,4-dichloro-6-hydroxyl-s-triazine sodium solt (0.08 g/m$^2$)

Gelatine (1.80 g/m$^2$)

These samples were subjected to film hardening treatment at 40° C. and a relative humidity of 70% for 14 hr.

Thereafter, 10 to $10^{-5}$ sec exposure was carried out through sharp cut filter SC-62, infrared cut filter and continuous wedge manufactured by Fuji Photo Film Co., Ltd. with the use of white light of 5500 K color temperature. In the $3\times10^{-9}$ sec exposure, the following exposure device was employed. The third harmonics (oscillation wavelength: 355 nm) were taken out by a nonlinear optical crystal from Nd:YAG laser using a white Xe flash lamp as a light source (manufactured by Coherent, U.S.A., oscillation wavelength: 1064 nm), and modulated to 650 nm beams by an optical parametric oscillator. The resultant 650 nm laser beams were elongated in the direction perpendicular to the traveling direction of beams by means of a cylindrical lens and regulated so as to realize an appropriate exposure quantity by means of a filter for uniformalizing the beam quantity. The samples were exposed through a continuous wedge to the laser beams. The laser beams were those of single pulse whose pulse width was $3\times10^{-9}$ sec.

After the exposure, the samples were developed in the following manner, and the photographic performance thereof were evaluated by conducting a density measurement through a green filter.

By using the FP-350 negative processor manufactured by Fuji Photo Film Co., Ltd., the resultant samples were processed by the following method (until the accumulated replenisher amount of each solution was three times the mother solution tank volume).

(Processing Method)

| Step | Time | Temperature | Replenishment rate* |
|---|---|---|---|
| Color development | 2 min. 45 sec. | 38° C. | 45 mL |
| Bleaching | 1 min. 00 sec. | 38° C. | 20 mL bleaching solution overflow was entirely supplied into bleach-fix tank |
| Bleach-fix | 3 min. 15 sec. | 38° C. | 30 mL |
| Washing (1) | 40 sec. | 35° C. | counter flow piping from (2) to (1) |
| Washing (2) | 1 min. 00 sec. | 35° C. | 30 mL |
| Stabilization | 40 sec. | 38° C. | 20 mL |
| Drying | 1 min. 15 sec. | 55° C. | |

*The replenishment rate is represented by a value per 1.1 m of a 35-mm wide sample (equivalent to one role of 24 Ex. film).

The compositions of the processing solutions are presented below.

| (Color developer) | Tank solution (g) | Replenisher (g) |
|---|---|---|
| Diethylenetriamine pentaacetic acid | 1.0 | 1.1 |
| 1-hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxyaminesulfate | 2.4 | 2.8 |
| 4-[N-ethyl-N-(β-hydroxy ethyl)amino]-2-methyl aniline sulfate | 4.5 | 5.5 |
| Water to make | 1.0 L | 1.0 L |
| pH (adjusted by potassium hydroxide and sulfuric acid) | 10.05 | 10.10 |

| (Bleaching solution) | common to tank solution and replenisher (g) |
|---|---|
| Ferric ammonium ethylenediamine tetraacetate dihydrate | 120.0 |
| Disodium ethylenediamine tetraacetate | 10.0 |
| Animonium bromide | 100.0 |
| Ammonium nitrate | 10.0 |
| Bleaching accelerator $(CH_3)_2N—CH_2—CH_2—S—S—CH_2—CH_2—N(CH_3)_2.2HCl$ | 0.005 mol |
| Ammonia water (27%) | 15.0 mL |
| Water to make | 1.0 L |
| pH (adjusted by ammonia water and nitric acid) | 6.3 |

| (Bleach-fix bath) | Tank solution (g) | Replenisher (g) |
|---|---|---|
| Ferric ammnonium ethylene | 50.0 | — |

-continued

| | | |
|---|---|---|
| diaminetetraacetate dihydrate | | |
| Disodium ethylenediamine tetraacetate | 5.0 | 2.0 |
| Sodium sulfite | 12.0 | 20.0 |
| Aqueous ammonium thiosulfate solution (700 g/L) | 240.0 mL | 400.0 mL |
| Ammonia water (27%) | 6.0 mL | — |
| Water to make | 1.0 L | 1.0 L |
| pH (adjusted by ammonia water and acetic acid) | 7.2 | 7.3 |

(Washing water)

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 0.15 g/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononyl phenylether (average polymerization degree 10) | 0.2 |
| Disodium ethylenediaminetetraacetate | 0.05 |
| 1,2,4-triazole | 1.3 |
| 1,4-bis(1,2,4-triazole-1-ylmethyl) piperazine | 0.75 |
| Water to make | 1.0 L |
| pH | 8.5 |

The sensitivity was expressed in a relative value of reciprocal of exposure amount required to give a fog density plus 0.15. The sensitivity of Sample 101 is assumed to be 100. The sensitivity difference between the sensitivity obtained with an exposure time of $10^{-5}$ sec and the sensitivity obtained with an exposure time of 10 sec, was expressed in terms of the sensitivity unit. The sensitivity difference between the sensitivity obtained with an exposure time of $3\times10^{-9}$ sec and the sensitivity obtained with an exposure time of $10^{-5}$ sec was also expressed by the sensitivity unit.

Next, in order to evaluate the resistance to irradiation, γ-ray from radio isotope $^{60}$Co (1.173, 1.333 MeV) was irradiated to each of Samples 101 to 130 in an amount of 0.2R. Subsequently, the same exposure and the processing as mentioned above were conducted. Density of the irradiated samples were measured to obtain a value of fog density. Increment of fog density caused by irradiation was calculated from the fog densities of the irradiated sample and that of the non-irradiated sample. The increment of fog density of each sample was expressed in terms of relative value with respect to the increment of fog density of Sample 101. The increment of fog density of Sample 101 was 0.087.

Table 3 sets forth relative sensitivity, sensitivity difference of exposure times of $10^{-5}$ sec and 10 sec, sensitivity difference of exposure times of $3\times10^{-9}$ sec and $10^{-5}$ sec, increment of fog due to irradiation, and a ratio of the relative sensitivity to the increment of fog due to irradiation of each sample.

TABLE 3

| Sample No. | Emulsion used | A Relative sensitivity | Difference of sensitivities between exposure times of $10^{-5}$ sec and 10 sec | difference of sensitivities between exposure times of $3 \times 10^{-9}$ sec and $10^{-5}$ sec | B Increment of fog due to exposure to radiation | A/B | Remarks |
|---|---|---|---|---|---|---|---|
| 101 | 1-A | 100 | 22 | 12 | 100 | 1.00 | Comparative example |
| 102 | 1-B | 95 | 33 | 24 | 98 | 0.97 | Comparative example |
| 103 | 1-C | 93 | 38 | 43 | 85 | 1.09 | Invention |
| 104 | 1-D | 95 | 42 | 61 | 87 | 1.09 | Invention |
| 105 | 1-E | 69 | 84 | 86 | 58 | 1.19 | Invention |
| 106 | 1-F | 126 | 26 | 15 | 149 | 0.85 | Comparative example |
| 107 | 1-G | 129 | 37 | 26 | 146 | 0.88 | Comparative example |
| 108 | 1-H | 132 | 43 | 47 | 122 | 1.08 | Invention |
| 109 | 1-I | 129 | 51 | 65 | 109 | 1.18 | Invention |
| 110 | 1-J | 87 | 91 | 90 | 74 | 1.18 | Invention |
| 111 | 1-K | 191 | 27 | 11 | 203 | 0.94 | Comparative example |
| 112 | 1-L | 186 | 39 | 25 | 191 | 0.97 | Comparative example |
| 113 | 1-M | 182 | 46 | 39 | 158 | 1.15 | Invention |
| 114 | 1-N | 191 | 52 | 58 | 155 | 1.23 | Invention |
| 115 | 1-O | 117 | 88 | 92 | 98 | 1.19 | Invention |

TABLE 3-continued

| Sample No. | Emulsion used | A Relative sensitivity | Difference of sensitivities between exposure times of $10^{-5}$ sec and 10 sec | difference of sensitivities between exposure times of $3 \times 10^{-9}$ sec and $10^{-5}$ sec | B Increment of fog due to exposure to radiation | A/B | Remarks |
|---|---|---|---|---|---|---|---|
| 116 | 1-P | 214 | 29 | 13 | 264 | 0.81 | Comparative example |
| 117 | 1-Q | 209 | 37 | 24 | 224 | 0.93 | Comparative example |
| 118 | 1-R | 214 | 48 | 47 | 178 | 1.20 | Invention |
| 119 | 1-S | 219 | 54 | 69 | 174 | 1.26 | Invention |
| 120 | 1-T | 138 | 87 | 94 | 115 | 1.20 | Invention |
| 121 | 1-U | 245 | 31 | 14 | 354 | 0.69 | Comparative example |
| 122 | 1-V | 240 | 39 | 22 | 291 | 0.82 | Comparative example |
| 123 | 1-W | 245 | 49 | 46 | 219 | 1.12 | Invention |
| 124 | 1-X | 240 | 51 | 71 | 191 | 1.26 | Invention |
| 125 | 1-Y | 234 | 45 | 39 | 224 | 1.04 | Invention |
| 126 | 1-Z | 245 | 50 | 48 | 209 | 1.17 | Invention |
| 127 | 1-AA | 240 | 53 | 62 | 195 | 1.23 | Invention |
| 128 | 1-AB | 245 | 56 | 74 | 182 | 1.35 | Invention |
| 129 | 1-AC | 251 | 57 | 82 | 170 | 1.48 | Invention |
| 130 | 1-AD | 155 | 94 | 91 | 123 | 1.26 | Invention |

It is apparent from Table 3 that an emulsion exhibiting a high speed and improved in radiation resistance can be obtained from tabular grains of large equivalent circle diameter and small thickness which exhibit a large speed difference between $3\times10^{-9}$ sec exposure time and $10^{-5}$ sec exposure time according to the present invention.

Example 2

Preparation and Evaluation of Emulsions 2-A to 2-O

Emulsions 2-A to 2-O which are different from each other in the variation coefficient of equivalent circle diameter distribution of all grains were prepared in the same manner as the emulsions 1-D, 1-I, 1-N, 1-S and 1-X, except that the grain formation conditions were modified.

The grain characteristics of obtained emulsions are listed in Table 4. Coated samples 201 to 215 were prepared from these emulsions and evaluated in the same manner as in Example 1. The results are also listed in Table 4.

TABLE 4

| Sample No. | Emulsion used | Shape of grains that occupy 50% or more of the total projected area | Coefficient of variation of distribution of equivalent circle diameters of all the grains (%) | A Relative sensitivity | Difference of sensitivities between exposure times of $10^{-5}$ sec and 10 sec | Difference of sensitivities between exposure times of $3 \times 10^{-9}$ sec and $10^{-5}$ sec | B Increment of fog due to exposure to radiation | A/B | Remarks |
|---|---|---|---|---|---|---|---|---|---|
| 201 | 2-A | Dc ≦ 3.0 gm and th ≧ 0.25 μm | 35 | 100 | 29 | 67 | 100 | 1.00 | Comparative example |
| 202 | 2-B | Dc ≦ 3.0 μm and th ≧ 0.25 μm | 45 | 91 | 26 | 29 | 111 | 0.82 | Comparative example |
| 203 | 2-C | Dc ≦ 3.0 μm and th ≧ 0.25 μm | 20 | 95 | 25 | 73 | 98 | 0.97 | Comparative example |
| 204 | 2-D | Dc ≦ 3.0 μm and th ≦ 0.25 μm | 35 | 126 | 31 | 73 | 114 | 1.11 | Invention |
| 205 | 2-E | Dc ≧ 3.0 μm and th ≦ 0.25 μm | 45 | 114 | 27 | 28 | 122 | 0.93 | Comparative example |
| 206 | 2-F | Dc ≧ 3.0 μm and th ≦ 0.25 μm | 20 | 138 | 25 | 82 | 105 | 1.31 | Invention |
| 207 | 2-G | Dc ≧ 3.0 μm and th ≦ 0.15 μm | 35 | 182 | 34 | 82 | 151 | 1.21 | Invention |
| 208 | 2-H | Dc ≧ 3.0 μm and th ≦ 0.15 μm | 45 | 166 | 26 | 27 | 181 | 0.92 | Comparative example |
| 209 | 2-I | Dc ≧ 3.0 μm and th ≦ 0.15 μm | 20 | 186 | 24 | 96 | 142 | 1.31 | Invention |
| 210 | 2-J | Dc ≧ 4.0 μm and th ≦ 0.15 μm | 35 | 209 | 35 | 90 | 170 | 1.23 | Invention |
| 211 | 2-K | Dc ≧ 4.0 μm and th ≦ 0.15 μm | 45 | 166 | 28 | 25 | 210 | 0.79 | Comparative example |
| 212 | 2-L | Dc ≧ 4.0 μm and th ≦ 0.15 μm | 20 | 219 | 23 | 107 | 162 | 1.35 | Invention |

TABLE 4-continued

| Sample No. | Emulsion used | Shape of grains that occupy 50% or more of the total projected area | Coefficient of variation of distribution of equivalent circle diameters of all the grains (%) | A Relative sensitivity | Difference of sensitivities between exposure times of $10^{-5}$ sec and 10 sec | Difference of sensitivities between exposure times of $3 \times 10^{-9}$ sec and $10^{-5}$ sec | B Increment of fog due to exposure to radiation | A/B | Remarks |
|---|---|---|---|---|---|---|---|---|---|
| 213 | 2-M | Dc ≧ 4.0 μm and th ≦ 0.10 μm | 35 | 234 | 37 | 102 | 182 | 1.29 | Invention |
| 214 | 2-N | Dc ≧ 4.0 μm and th ≦ 0.10 μm | 45 | 209 | 25 | 24 | 275 | 0.76 | Comparative example |
| 215 | 2-O | Dc ≧ 4.0 μm and th ≦ 0.10 μm | 20 | 251 | 21 | 117 | 170 | 1.48 | Invention |

As is apparent from Table 4, tabular grains having a large equivalent circle diameter and a small thickness can attain high sensitivity and remarkably improved resistance to irradiation when the variation coefficient of the distribution of the equivalent circle diameters is 40% or less.

Example 3

Silver halide emulsions A to N were prepared by the following methods.

(Preparation method of emulsion A)

42.2L of an aqueous solution containing 31.7 g of low-molecular-weight gelatin having molecular weight of 15000 phthalated at a phthalation ratio of 97% and 31.7 g of KBr were vigorously stirred at 35° C. 1,583 mL of an aqueous solution containing 316.7 g of $AgNO_3$ and 1,583 mL of an aqueous solution containing 221.5 g of KBr and 52.7 g of gelatin-4 of Example 1 were added over 1 min by the double jet method. Immediately after the addition, 52.8 g of KBr were added, and 2,485 mL of an aqueous solution containing 398.2 g of $AgNO_3$ and 2,581 mL of an aqueous solution containing 291.1 g of KBr were added over 2 min by the double jet method. Immediately after the addition, 44.8 g of KBr were added. After that, the temperature was raised to 40° C. to ripen the material. After the ripening, 923 g of gelatin-2 of Example 1 and 79.2 g of KBr were added, and 15,974 mL of an aqueous solution containing 5,103 g of $AgNO_3$ and an aqueous KBr solution were added over 10 min by the double jet method while the flow rate was accelerated such that the final flow rate was 1.4 times the initial flow rate. During the addition, the pAg of the bulk emulsion solution in the reaction vessel was held at 9.90. After washing with water, gelatin-1 of Example 1 was added, the pH and the pAg were adjusted to 5.7 and 8.8, respectively, and the silver amount and the gelatin amount were adjusted to 131.8 g and 64.1 g, respectively, per kg of the emulsion, thereby preparing a seed emulsion.

1,211 mL of an aqueous solution containing 46 g of gelatin-2 of Example 1 and 1.7 g of KBr were vigorously stirred at 75° C. After 9.9 g of the seed emulsion were added, 0.3 g of modified silicone oil (L7602 manufactured by Nippon Uniker K.K.) was added. $H_2SO_4$ was added to adjust the pH to 5.5, and 67.6 mL of an aqueous solution containing 7.0 g of $AgNO_3$ and an aqueous KBr solution were added over 6 min by the double jet method while the flow rate was accelerated such that the final flow rate was 5.1 times the initial flow rate. During the addition, the pAg of the bulk emulsion solution in the reaction vessel was held at 8.15. After 2 mg of sodium benzenethiosulfonate and 2 mg of thiourea dioxide were added, 328 mL of an aqueous solution containing 105.6 g of $AgNO_3$ and an aqueous KBr solution were added over 56 min by the double jet method while the flow rate was accelerated such that the final flow rate was 3.7 times the initial flow rate. During the addition, an AgI fine grain emulsion having a grain size of 0.037 μm was simultaneously added at an accelerated flow rate so that the silver iodide content was 27 mol %. At the same time, the pAg of the bulk emulsion solution in the reaction vessel was held at 8.60. 121.3 mL of an aqueous solution containing 45.6 g of $AgNO_3$ and an aqueous KBr solution were added over 22 min by the double jet method. During the addition, the pAg of the bulk emulsion solution in the reaction vessel was held at 7.60. The temperature was raised to 82° C., KBr was added to adjust the pAg of the bulk emulsion solution in the reaction vessel to 8.80, and the abovementioned AgI fine grain emulsion was added in an amount of 6.33 g in terms of a KI weight. Immediately after the addition, 206.2 mL of an aqueous solution containing 66.4 g of $AgNO_3$ were added over 16 min. For the first 5 min of the addition, the pAg of the bulk emulsion solution in the reaction vessel was held at 8.80.

After washing with water, gelatin-1 of Example 1 was added, the pH and the pAg were adjusted to 5.8 and 8.7, respectively, at 40° C. After TAZ-1 was added, the temperature was raised to 60° C. After sensitizing dye ExS-4 was added, potassium thiocyanate, chloroauric acid, sodium thiosulfate, and N,N-dimethylselenourea were added to optimally perform chemical sensitization. At the end of this chemical sensitization, compounds MER-1 and MER-2 were added. "Optimal chemical sensitization" herein means that the addition amount of each of the sensitizing dyes and the compounds was $10^{-1}$ to $10^{-8}$ mol per mol of a silver halide.

Spectral sensitizing dye Exs-4 for the blue-sensitive emulsion

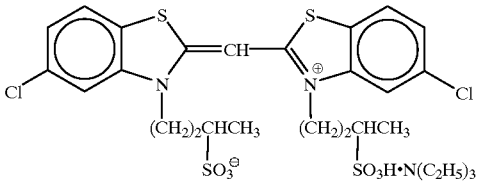

TAZ-1

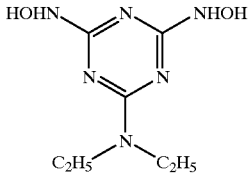

-continued

MER-1

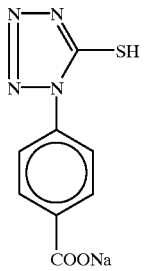

MER-3

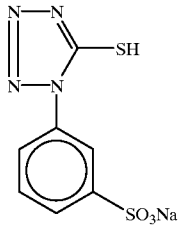

(Preparation method of emulsion B)

1,192 mL of an aqueous solution containing 0.96 g of gelatin-4 of Example 1 and 0.9 g of KBr were vigorously stirred at 40° C. 37.5 mL of an aqueous solution containing 1.49 g of $AgNO_3$ and 37.5 mL of an aqueous solution containing 1.05 g of KBr were added over 30 sec by the double jet method. After 1.2 g of KBr were added, the temperature was raised to 75° C. to ripen the material. After the ripening, 35 g of gelatin-3 of Example 1 were added, and the pH was adjusted to 7. 6 mg of thiourea dioxide were added. 116 mL of an aqueous solution containing 29 g of $AgNO_3$ and an aqueous KBr solution were added by the double jet method while the flow rate was accelerated such that the final flow rate was 3 times the initial flow rate. During the addition, the pAg of the bulk emulsion solution in the reaction vessel was held at 8.15. 440.6 mL of an aqueous solution containing 110.2 g of $AgNO_3$ and an aqueous KBr solution were added over 30 min by the double jet method while the flow rate was accelerated such that the final flow rate was 5.1 times the initial flow rate. During the addition, the AgI fine grain emulsion used in the preparation of the emulsion A was simultaneously added at an accelerated flow rate so that the silver iodide content was 15.8 mol %. At the same time, the pAg of the bulk emulsion solution in the reaction vessel was held at 7.85.

96.5 mL of an aqueous solution containing 24.1 g of $AgNO_3$ and an aqueous KBr solution were added over 3 min by the double jet method. During the addition, the pAg of the bulk emulsion solution in the reaction vessel was held at 7.85. After 26 mg of sodium ethylthiosulfonate were added, the temperature was raised to 55° C., an aqueous KBr solution was added to adjust the pAg of the bulk emulsion solution in the reaction vessel to 9.80. The aforementioned AgI fine grain emulsion was added in an amount of 8.5 g in terms of a KI weight. Immediately after the addition, 228 mL of an aqueous solution containing 57 g of $AgNO_3$ were added over 5 min. During the addition, an aqueous KBr solution was used to adjust the pAg of the bulk emulsion solution in the reaction vessel such that the pAg was 8.75 at the end of the addition. The resultant emulsion was washed with water and chemically sensitized while compound Exs-4 was used as a spectral sensitizing dye.

(Preparation method of emulsion C)

1,192 mL of an aqueous solution containing 1.02 g of gelatin-2 of Example 1 and 0.9 g of KBr were vigorously stirred at 35° C. 42 mL of an aqueous solution containing 4.47 g of $AgNO_3$ and 42 mL of an aqueous solution containing 3.16 g of KBr were added over 9 sec by the double jet method. After 2.6 g of KBr were added, the temperature was raised to 63° C. to ripen the material. After the ripening, 41.2 g of gelatin-3 of Example 1 and 18.5 g of NaCl were added. After the pH was adjusted to 7.2, 8 mg of dimethylamineborane were added. 203 mL of an aqueous solution containing 26 g of $AgNO_3$ and an aqueous KBr solution were added by the double jet method while the flow rate was accelerated such that the final flow rate was 3.8 times the initial flow rate. During the addition, the pAg of the bulk emulsion solution in the reaction vessel was held at 8.65. 440.6 mL of an aqueous solution containing 110.2 g of $AgNO_3$ and an aqueous KBr solution were added over 24 min by the double jet method while the flow rate was accelerated such that the final flow rate was 5.1 times the initial flow rate. During the addition, the AgI fine grain emulsion used in the preparation of the emulsion A was simultaneously added at an accelerated flow rate so that the silver iodide content was 2.3 mol %. At the same time, the pAg of the bulk emulsion solution in the reaction vessel was held at 8.50. After 10.7 mL of an aqueous 1 N potassium thiocyanate solution were added, 153.5 mL of an aqueous solution containing 24.1 g of $AgNO_3$ and an aqueous KBr solution were added over 2 min 30 sec by the double jet method. During the addition, the pAg of the bulk emulsion solution in the reaction vessel was held at 8.05. An aqueous KBr solution was added to adjust the pAg of the bulk emulsion solution in the reaction vessel to 9.25. The aforementioned AgI fine grain emulsion was added in an amount of 6.4 g in terms of a KI weight. Immediately after the addition, 404 mL of an aqueous solution containing 57 g of $AgNO_3$ were added over 45 min. During the addition, an aqueous KBr solution was used to adjust the pAg of the bulk emulsion solution in the reaction vessel such that the pAg was 8.65 at the end of the addition. After water washing, the emulsion was chemically sensitized while using compound Exs-4 as a spectral sensitizer.

(Preparation method of emulsion D)

In the preparation of the emulsion C, the $AgNO_3$ addition amount during nucleation was increased by 2.3 times. Also, in the final addition of 404 mL of an aqueous solution containing 57 g of $AgNO_3$, the pAg of the bulk emulsion solution in the reaction vessel was adjusted to 6.85 by using an aqueous KBr solution. An emulsion D was prepared following substantially the same procedures as for the emulsion C except the foregoing.

(Preparation method of emulsion E)

1,200 mL of an aqueous solution containing 0.38 g of gelatin-2 of Example 1 and 0.9 g of KBr were held at 60° C. and stirred with violence at pH 2. An aqueous solution containing 1.03 g of $AgNO_3$ and an aqueous solution containing 0.88 g of KBr and 0.09 g of KI were added over 30 sec by the double jet method. After the termination of ripening, 12.8 g of gelatin-3 of Example 1 were added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 39 min by the double jet method. During the addition, the pAg of the bulk emulsion solution in the reaction vessel was kept at 9.05. An aqueous solution containing 65.6 g of $AgNO_3$ and an aqueous KBr solution were added over 46 min by the double jet method while the flow rate was accelerated so that the final flow rate was 2.1 times the initial flow rate. During the addition, the AgI fine grain emulsion used in the preparation of Emulsion A was simultaneously added such that the silver iodide content became 6.5 mol %, and the pAg of the bulk emulsion solution in the reaction vessel was held at 9.05.

After 1.5 mg of thiourea dioxide was added, 132 mL of an aqueous solution containing 41.8 g of $AgNO_3$ and an aqueous KBr solution were added over 16 min. The addition of the KBr solution was controlled so that the pAg of the bulk emulsion solution in a reaction vessel at the termination of the addition became 7.70. After 2 mg of sodium benzenethiosulfonate was added, KBr was added to adjust the pAg of the bulk emulsion solution in the reaction vessel at 9.80. The above mentioned KI fine grain emulsion was added in an amount of 6.2 g in terms of KI weight. Immediately after the addition, 300 mL of an aqueous solution containing 88.5 g of $AgNO_3$ over 10 min. An aqueous KBr solution was added to adjust the pAg of the bulk emulsion solution in the reaction vessel at the termination of the addition to 7.40. After washing with water, gelatin-1 of Example 1 was added, and the pH and the pAg were adjusted to 6.5 and 8.2, respectively. After the compound TAZ-1 was added, the temperature was raised to 58° C. After sensitizing dyes Exs-7 to Exs-9 were added, $K_2IrCl_6$, potassium thiocyanate, chloroauric acid, sodium thiosulfonate, and N,N-dimethylselenourea were added to perform optimum chemical sensitization. At the end of the chemical sensitization, the compounds MER-1 and MER-3 were added.

Spectral sensitizing dye Exs-7 for the green-sensitive emulsion

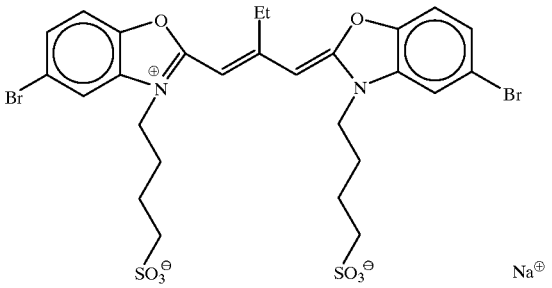

Spectral sensitizing dye Exs-8 for the green-sensitive emulsion

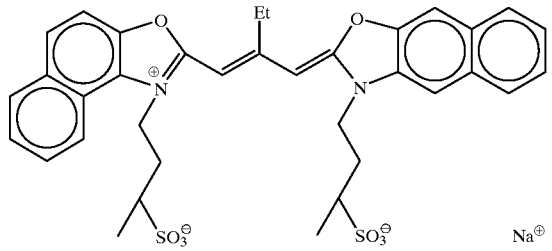

Spectral sensitizing dye Exs-9 for the green-sensitive emulsion

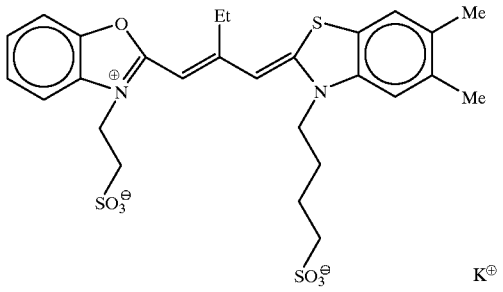

-continued

Spectral sensitizing dyes used in the green-sensitive emulsion are a mixture of Exs-7, Exs-8 and Exs-9 in a molar ratio of 77:20:3

(Preparation method of emulsion F)

1,200 mL of an aqueous solution containing 0.75 g of gelatin-4 of Example 1 and 0.9 g of KBr were held at 39° C. and stirred with violence at pH 1.8. An aqueous solution containing 1.85 g of $AgNO_3$ and an aqueous KBr solution containing 1.5 mol % of KI were added over 16 sec by the double jet method. During the addition, the excess KBr concentration was held constant. The temperature was raised to 54° C. to ripen the material. After the ripening, 20 g of gelatin-2 of Example 1 were added. After the pH was adjusted to 5.9, 2.9 g of KBr were added. 288 mL of an aqueous solution containing 27.4 g of $AgNO_3$ and an aqueous KBr solution were added over 53 min by the double jet method. During the addition, an AgI fine grain emulsion having a grain size of 0.03 $\mu$m was simultaneously added such that the silver iodide content was 4.1 mol %. At the same time, the pAg of the bulk emulsion solution in the reaction vessel was held at 9.40.

After 2.5 g of KBr were added, an aqueous solution containing 87.7 g of $AgNO_3$ and an aqueous KBr solution were added over 63 min by the double jet method while the flow rate was accelerated so that the final flow rate was 1.2 times the initial flow rate. During the addition, abovementioned AgI fine grain emulsion was simultaneously added such that the silver iodide content was 10.5 mol %. At the same time, the pAg of the bulk emulsion solution in the reaction vessel was held at 9.50. 132 mL of an aqueous solution containing 41.8 g of $AgNO_3$ and an aqueous KBr solution were added over 25 min by the double jet method. The addition of the aqueous KBr solution was so adjusted that the pAg of the bulk emulsion solution in the reaction vessel was 8.15 at the end of the addition. The pH was adjusted to 7.3, and 1 mg of thiourea dioxide was added. After KBr was added to adjust the pAg of the bulk emulsion solution in the reaction vessel to 9.50, the aforementioned AgI fine grain emulsion was added in an amount of 8.78 g in terms of a KI weight. Immediately after the addition, 609 mL of an aqueous solution containing 63.3 g of $AgNO_3$ were added over 10 min. For the first 6 min of the addition, the pAg of the bulk emulsion solution in the reaction vessel was held at 9.50 by an aqueous KBr solution. After washing with water, gelatin-1 of Example 1 was added, and the pH and the pAg were adjusted to 6.5 and 8.2, respectively. Optimal chemical sensitization was performed while using the compounds Exs-7 to Exs-9 as spectral sensitizing dyes.

(Preparation method of emulsion G)

1,200 mL of an aqueous solution containing 0.70 g of gelatin-4 of Example 1, 0.9 g of KBr, 0.175 g of KI, and 0.2 g of the modified silicone oil used in the preparation of the emulsion A were held at 33° C. and stirred with violence at pH 1.8. An aqueous solution containing 1.8 g of $AgNO_3$ and an aqueous KBr solution containing 3.2 mol % of KI were added over 9 sec by the double jet method. During the addition, the excess KBr concentration was held constant. The temperature was raised to 62° C. to ripen the material. After the ripening, 27.8 g of gelatin-3 of Example 1 were added. After the pH was adjusted to 6.3, 2.9 g of KBr were added. 270 mL of an aqueous solution containing 27.58 g of $AgNO_3$ and an aqueous KBr solution were added over 37 min by the double jet method. During the addition, an AgI fine grain emulsion having a grain size of 0.008 $\mu$m was simultaneously added such that the silver iodide content was 4.1 mol %. This AgI fine grain emulsion was prepared, immediately before the addition, by mixing an aqueous solution of gelatin-4 of Example 1, an aqueous $AgNO_3$ solution, and an aqueous KI solution in another chamber having a magnetic coupling inductive stirrer described in JP-A-10-43570. At the same time, the pAg of the bulk emulsion solution in the reaction vessel was held at 9.15. After 2.6 g of KBr were added, an aqueous solution containing 87.7 g of $AgNO_3$ and an aqueous KBr solution were added over 49 min by the double jet method while the flow rate was accelerated so that the final flow rate was 3.1 times the initial flow rate. During the addition, the aforementioned AgI fine grain emulsion prepared by mixing immediately before addition was simultaneously added at an accelerated flow rate such that the silver iodide content was 7.9 mol %. At the same time, the pAg of the bulk emulsion solution in the reaction vessel was held at 9.30.

After 1 mg of thiourea dioxide was added, 132 mL of an aqueous solution containing 41.8 g of $AgNO_3$ and an aqueous KBr solution were added over 20 min by the double jet method. The addition of the aqueous KBr solution was so adjusted that the pAg of the bulk emulsion solution in the reaction vessel as 7.90 at the end of the addition. After the temperature was raised to 78° C. and the pH was adjusted to 9.1, KBr was added to adjust the pAg of the bulk emulsion solution in the reaction vessel to 8.70. The AgI fine grain emulsion used in the preparation of the emulsion A was added in an amount of 5.73 g in terms of a KI weight. Immediately after the addition, 321 mL of an aqueous solution containing 66.4 g of $AgNO_3$ were added over 4 min. For the first 2 min of the addition, the pAg of the bulk emulsion solution in the reaction vessel was held at 8.70. After washing with water, chemical sensitization was performed while using the compounds Exs-7 to Exs-9 as spectral sensitizers.

(Preparation method of emulsion H)

An aqueous solution containing 17.8 g of gelatin-1 of Example 1, 6.2 g of KBr, and 0.46 g of KI was vigorously stirred at 45° C. An aqueous solution containing 11.85 g of $AgNO_3$ and an aqueous solution containing 3.8 g of KBr were added over 45 sec by the double jet method. After the temperature was raised to 63° C., 24.1 g of gelatin-1 of Example 1 were added to ripen the material. After the ripening, an aqueous solution containing 133.4 g of $AgNO_3$ and an aqueous KBr solution were added over 20 min by the double jet method such that the final flow rate was 2.6 times the initial flow rate. During the addition, the pAg of the bulk emulsion solution in the reaction vessel was held at 7.60. Also, ten minutes after the start of the addition 0.1 mg of $K_2IrCl_6$ was added. After 7 g of NaCl were added, an aqueous solution containing 45.6 g of $AgNO_3$ and an aqueous KBr solution were added over 12 min by the double jet method. During the addition, the pAg of the bulk emulsion solution in the reaction vessel was held at 6.90. Also, over 6 min from the start of the addition, 100 mL of an aqueous solution containing 29 mg of yellow prussiate were added. After 14.4 g of KBr were added, the AgI fine grain emulsion used in the preparation of the emulsion A was added in an amount of 6.3 g as a KI weight. Immediately after the addition, an aqueous solution containing 42.7 g of $AgNO_3$ and an aqueous KBr solution were added over 11 min by the double jet method. During the addition, the pAg of the bulk emulsion solution in the reaction vessel was held at 6.90. After washing with water, chemical sensitization was performed while using the compounds Exs-7 to Exs-9 as spectral sensitizing dyes.

(Preparation method of emulsion I)

An emulsion I was prepared following substantially the same procedures as for the emulsion H, except that the nucleation temperature was changed to 35° C.

(Preparation method of emulsion J)

1,200 mL of an aqueous solution containing 0.75 g of gelatin-4 of Example 1 and 0.9 g of KBr were held at 39° C. and stirred with violence at pH 1.8. An aqueous solution containing 0.34 g of $AgNO_3$ and an aqueous KBr solution containing 1.5 mol % of KI were added over 16 sec by the double jet method. During the addition, the excess KBr concentration was held constant. The temperature was raised to 54° C. to ripen the material. After the ripening, 20 g of gelatin-2 of Example 1 were added. The pH was adjusted to 5.9, and 2.9 g of KBr were added. After 3 mg of thiourea dioxide were added, and 288 mL of an aqueous solution containing 28.8 g of $AgNO_3$ and an aqueous KBr solution were added over 58 min by the double jet method. During the addition, an AgI fine grain emulsion having a grain size of 0.03 $\mu$m was simultaneously added such that the silver iodide content was 4.1 mol %. At the same time, the pAg of the bulk emulsion solution in the reaction vessel was held at 9.40. After 2.5 g of KBr were added, an aqueous solution containing 87.7 g of $AgNO_3$ and an aqueous KBr solution were added over 69 min by the double jet method while the flow rate was accelerated so that the final flow rate was 1.2 times the initial flow rate. During the addition, the above-mentioned AgI fine grain emulsion was simultaneously added such that the silver iodide content was 10.5 mol %. At the same time, the pAg of the bulk emulsion solution in the reaction vessel was held at 9.50.

132 mL of an aqueous solution containing 41.8 g of $AgNO_3$ and an aqueous KBr solution were added over 27 min by the double jet method. The addition of the aqueous KBr solution was so adjusted that the pAg of the bulk emulsion solution in the reaction vessel was 8.15 at the end of the addition. After 2 mg of sodium benzenethiosulfonate were added, KBr was added to adjust the pAg of the bulk emulsion solution in the reaction vessel to 9.50, and the aforementioned AgI fine grain emulsion was added in an amount of 5.73 in terms of a KI weight. Immediately after the addition, 609 mL of an aqueous solution containing 66.4 g of $AgNO_3$ were added over 11 min. For the first 6 min of the addition, the pAg of the bulk emulsion solution in the reaction vessel was held at 9.50 by an aqueous KBr solution. After washing with water, gelatin was added, the pH and the pAg were adjusted to 6.5 and 8.2, respectively, at 40° C. Then, TAZ-1 was added and the temperature was raised to 56° C. The sensitizing dyes Exs-5 and Exs-6 (a mixing ratio=69:31) was added. After that, potassium thiocyanate, chloroauric acid, sodium thiosulfate, and N,N-dimethylselenourea were added to ripen and optimally chemically sensitize the emulsion. At the end of the chemical sensitization, MER-1 and MER-3 were added.

Exs-5

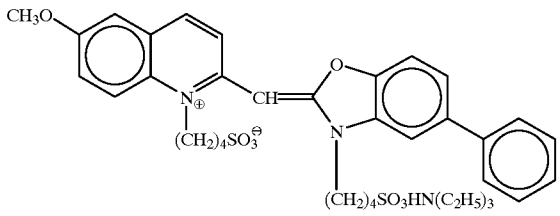

-continued

Exs-6

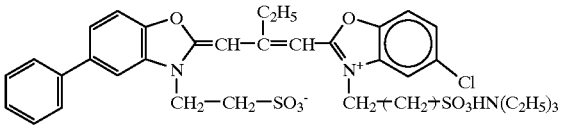

(Preparation method of emulsion K)

1,200 mL of an aqueous solution containing 0.38 g of gelatin-2 of Example 1 and 0.9 g of KBr were held at 60° C. and stirred with violence at pH 2. An aqueous solution containing 1.96 g of $AgNO_3$ and an aqueous solution containing 1.67 g of KBr and 0.172 g of KI were added over 30 sec by the double jet method. After ripening, 12.8 g of gelatin-3 of Example 1 were added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 39 min by the double jet method. During the addition, the pAg of the bulk emulsion solution in the reaction vessel was held at 9.05.

An aqueous solution containing 65.6 g of $AgNO_3$ and an aqueous KBr solution were added over 46 min by the double jet method while the flow rate was accelerated so that the final flow rate was 2.1 times the initial flow rate. During the addition, the AgI fine grain emulsion used in the preparation of the emulsion A was simultaneously added at an accelerated flow rate such that the silver iodide content was 6.5 mol %. At the same time, the pAg of the bulk emulsion solution in the reaction vessel was held at 9.05.

After 1.5 mg of thiourea dioxide were added, 132 mL of an aqueous solution containing 41.8 g and an aqueous KBr solution were added over 16 min by the double jet method. The addition of the aqueous KBr solution was so adjusted that the pAg of the bulk emulsion solution in the reaction vessel as 7.70 at the end of the addition. After 2 mg of sodium benzenethiosulfonate were added, KBr was added to adjust the pAg of the bulk emulsion solution in the reaction vessel to 9.80. The abovementioned AgI fine grain emulsion was added in an amount of 6.2 g in terms of a KI weight. Immediately after the addition, 300 mL of an aqueous solution containing 88.5 g of $AgNO_3$ were added over 10 min. An aqueous KBr solution was added to adjust pAg of the bulk emulsion solution in the reaction vessel such that the pAg was 7.40 at the end of the addition. After washing with water, gelatin-1 of Example 1 was added, the pH and the pAg were adjusted to 6.5 and 8.2, respectively at 40° C. After TAZ-1 was added, the temperature was raised to 61° C. The sensitizing dyes Exs-1 to Exs-3 were added. After that, $K_2IrCl_6$, potassium thiocyanate, chloroauric acid, sodium thiosulfate, and N,N-dimethylselenourea were added to optimally perform chemical sensitization. At the end of the chemical sensitization, MER-1 and MER-3 were added.

Exs-1

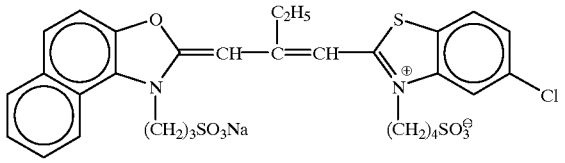

-continued

Exs-2

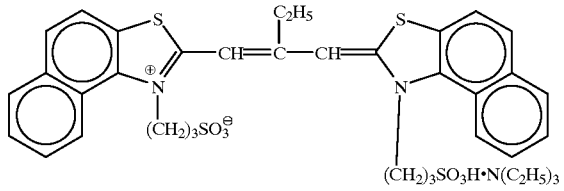

Exs-3

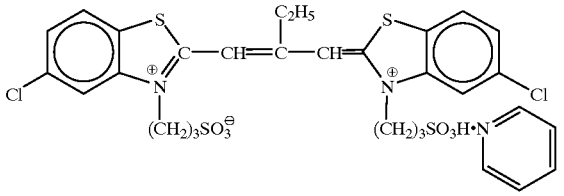

(Preparation method of emulsion L)

1,200 mL of an aqueous solution containing 4.9 g of gelatin-4 of Example 1 and 5.3 g of KBr were vigorously stirred at 40° C. 27 mL of an aqueous solution containing 8.75 g of $AgNO_3$ and 36 mL of an aqueous solution containing 6.45 g of KBr were added over 1 min by the double jet method. The temperature was raised to 75° C., and 21 mL of an aqueous solution containing 6.9 g of $AgNO_3$ were added over 2 min. After 26 g of $NH_4NO_3$ and 56 mL of 1 N NaOH were sequentially added, the material was ripened. After the ripening, the pH was adjusted to 4.8. 438 mL of an aqueous solution containing 141 g of $AgNO_3$ and 458 mL of an aqueous solution containing 102.6 g of KBr were added by the double jet method such that the final flow rate was 4 times the initial flow rate. The temperature was lowered to 55° C., 240 mL of an aqueous solution containing 7.1 g of $AgNO_3$ and an aqueous solution containing 6.46 g of KI were added over 5 min by the double jet method. After 7.1 g of KBr were added, 4 mg of sodium benzenethiosulfonate and 0.05 mg of $K_2IrCl_6$ were added. 177 mL of an aqueous solution containing 57.2 g of $AgNO_3$ and 223 mL of an aqueous solution containing 40.2 g of KBr were added over 8 min by the double jet method. The resultant emulsion was washed with water and chemically sensitized in substantially the same manner as for the emulsion J.

(Preparation methods of emulsions M and N)

Emulsions M and N were prepared following substantially the same procedures as for the emulsions G and P, respectively, except that chemical sensitization was performed in substantially the same manner as for the emulsion K.

Characteristic values of the above silver halide emulsions are summarized in Table 5 below. The surface iodide content can be examined as follows by XPS. That is, a sample was cooled to −115° C. in a vacuum of $6.7\times10^{-4}$ Pa or less and irradiated with MgKα, as probe X-rays, at an X-ray source voltage of 8 kV and an X-ray current of 20 mA, thereby measuring Ag3d5/2, Br3d, and I3d5/2 electrons. The integral intensities of the measured peaks were corrected by a sensitivity factor, and the surface iodide content was calculated from these sensitivity ratios. Note that dislocation lines as described in JP-A-3-237450 were observed by a high-voltage electron microscope in silver halide grains of the emulsions A to N.

TABLE 5

| Emulsion No. | Equivalent circle diameter (μm) Coefficient of variation (%) | Thickness (μm) Coefficient of variation (%) | Aspect ratio Coefficient of variation (%) | Tabularity | Distance between twin planes (μm) Coefficient of variation (%) | Ratio (%) of tabular grains having (111) main planes to the total projected area | Ratio (%) of (100) face to side faces | AgI content (mol %) Coefficient of variation (%) | AgCl content (mol %) | Surface AgI content (mol %) |
|---|---|---|---|---|---|---|---|---|---|---|
| A | 1.98 | 0.198 | 10 | 51 | 0.014 | 92 | 23 | 15 | 0 | 4.3 |
| | 23 | 28 | 35 | | 32 | | | 17 | | |
| B | 1.30 | 0.108 | 12 | 111 | 0.013 | 93 | 22 | 11 | 0 | 3.6 |
| | 25 | 27 | 38 | | 30 | | | 16 | | |
| C | 1.00 | 0.083 | 12 | 145 | 0.012 | 93 | 18 | 4 | 1 | 1.8 |
| | 27 | 26 | 37 | | 30 | | | 8 | | |
| D | 0.75 | 0.075 | 10 | 133 | 0.010 | 91 | 33 | 4 | 2 | 1.9 |
| | 31 | 18 | 29 | | 27 | | | 8 | | |
| E | 1.54 | 0.077 | 20 | 260 | 0.013 | 99 | 23 | 8.4 | 0 | 6.2 |
| | 26 | 18 | 33 | | 26 | | | 8 | | |
| F | 1.08 | 0.072 | 15 | 208 | 0.008 | 97 | 23 | 6 | 0 | 2.0 |
| | 18 | 15 | 19 | | 22 | | | 5 | | |
| G | 0.44 | 0.220 | 2 | 9 | 0.013 | 90 | 38 | 3 | 2 | 1.0 |
| | 16 | 13 | 9 | | 18 | | | 6 | | |
| H | 0.33 | 0.165 | 2 | 12 | 0.013 | 88 | 42 | 3 | 2 | 1.0 |
| | 17 | 13 | 12 | | 18 | | | 6 | | |
| I | 2.25 | 0.107 | 21 | 197 | 0.013 | 99 | 20 | 7.2 | 0 | 2.4 |
| | 31 | 19 | 34 | | 33 | | | 7 | | |
| J | 2.38 | 0.138 | 17 | 125 | 0.013 | 98 | 23 | 5 | 1 | 1.6 |
| | 20 | 20 | 23 | | 19 | | | 6 | | |
| K | 1.83 | 0.122 | 15 | 123 | 0.012 | 98 | 23 | 5 | 1 | 1.8 |
| | 18 | 20 | 22 | | 19 | | | 6 | | |
| L | 0.84 | 0.120 | 7 | 58 | 0.013 | 99 | 25 | 3 | 0 | 2.7 |
| | 17 | 18 | 19 | | 16 | | | 7 | | |
| M | 0.44 | 0.220 | 2 | 9 | 0.013 | 88 | 42 | 2 | 2 | 1.0 |
| | 17 | 13 | 12 | | 18 | | | 6 | | |
| N | 0.33 | 0.165 | 2 | 12 | 0.013 | 88 | 46 | 1 | 2 | 0.5 |
| | 17 | 13 | 12 | | 18 | | | 6 | | |
| O | 0.07 | 0.070 | 1 | — | — | — | — | 1 | 0 | — |
| | — | — | — | | — | | | — | | |
| P | 0.07 | 0.070 | 1 | — | — | — | — | 0.9 | 0 | — |
| | — | — | — | | | | | — | | |

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec, thereby obtaining a 90 μm thick PEN (polyethylenenaphthalate) film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hr, manufacturing a support with a high resistance to curling.

2) Coating of undercoat layer

The two surfaces of the above support were subjected to corona discharge, UV discharge, and glow discharge. After that, each surface of the support was coated with an undercoat solution (10 mL/m$^2$, by using a bar coater) consisting of 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, thereby forming an undercoat layer on a side at a high temperature upon orientation. Drying was performed at 115° C. for 6 min (all rollers and conveyors in the drying zone were at 115° C.)

3) Coating of back layers

One surface of the undercoated support was coated with an antistatic layer, magnetic recording layer, and slip layer having the following compositions as back layers.

3-1) Coating of antistatic layer

The surface was coated with 0.2 g/m$^2$ of a dispersion (secondary aggregation grain size =about 0.08 μm) of a fine-grain powder, having a specific resistance of 5 Ω·cm, of a tin oxide-antimony oxide composite material with an average grain size of 0.005 μm, together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and resorcin.

3-2) Coating of magnetic recording layer

A bar coater was used to coat the surface with 0.06 g/m$^2$ of cobalt-γ-iron oxide (specific area 43 m$^2$/g, major axis 0.14 μm, minor axis 0.03 μm, saturation magnetization 89 Am$^2$/kg, $Fe^{+2}/Fe^{+3}$=6/94, the surface was treated with 2 wt % of iron oxide by aluminum oxide silicon oxide) coated with 3-poly(polymerization degree 15)oxyethylene-propyloxytrimethoxysilane (15 wt %), together with 1.2 g/m$^2$ of diacetylcellulose (iron oxide was dispersed by an open kneader and sand mill), by using 0.3 g/m$^2$ of $C_2H_5C(CH_2OCONH{-}C_6H_3(CH_3)NCO)_3$ as a hardener and acetone, methylethylketone, and cyclohexane as solvents, thereby forming a 1.2-μm thick magnetic recording layer. 10 mg/m$^2$ of silica grains (0.3 μm) were added as a matting agent, and 10 mg/m$^2$ of aluminum oxide (0.15 μm) coated with 3-poly(polymerization degree 15)oxyethylene-propyloxytrimethoxysilane (15 wt %) were added as a polishing agent. Drying was performed at 115° C. for 6 min (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 $Am^2/kg$, $7.3\times10^4$ A/m, and 65%, respectively.

3-3) Preparation of slip layer

The surface was then coated with diacetylcellulose (25 $mg/m^2$) and a mixture of $C_6H_{13}CH(OH)C_{10}H_{20}COOC_{40}H_{81}$ (compound a, 6 $mg/m^2$)/$C_{50}H_{101}O(CH_2CH_2O)_{16}H$ (compound b, 9 $mg/m^2$). Note that this mixture was melted in xylene/propylenemonomethylether (1/1) at 105° C. and poured and dispersed in propylenemonomethylether (tenfold amount) at room temperature. After that, the resultant mixture was formed into a dispersion (average grain size 0.01 μm) in acetone before being added. 15 $mg/m^2$ of silica grains (0.3 μm) were added as a matting agent, and 15 $mg/m^2$ of aluminum oxide (0.15 μm) coated with 3-poly (polymerization degree 15)oxyethylene-propyloxytrimethoxysiliane (15 wt %) were added as a polishing agent. Drying was performed at 115° C. for 6 min (all rollers and conveyors in the drying zone were at 115° C.). The resultant slip layer was found to have excellent characteristics; the coefficient of kinetic friction was 0.06 (5 mmϕ stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4) Coating of sensitive layers (Sample 301)

The surface of the support on the side away from the back layers formed as above was coated with a plurality of layers having the following compositions to form a sample as a color negative sensitized material, thereby to prepare Sample 301.

(Compositions of sensitive layers)

The main ingredients used in the individual layers are classified as follows, however, the use thereof are not limited to those specified below.

ExC: Cyan coupler UV : Ultraviolet absorbent
ExM: Magenta coupler HBS: High-boiling organic solvent
ExY: Yellow coupler H : Gelatin hardener (In the following description, practical compounds have numbers attached to their symbols. Formulas of these compounds will be presented later.)

The number corresponding to each component indicates the coating amount in units of $g/m^2$. The coating amount of a silver halide is indicated by the amount of silver.

| 1st layer (1st antihalation layer) | | |
|---|---|---|
| Black colloidal silver | silver | 0.155 |
| Silver iodochlorobromide emulsion D | silver | 0.01 |
| Gelatin | | 0.87 |
| ExC-1 | | 0.002 |
| ExC-3 | | 0.002 |
| Cpd-2 | | 0.001 |
| HBS-1 | | 0.004 |
| HBS-2 | | 0.002 |

| 2nd layer (2nd antihalation layer) | | |
|---|---|---|
| Black colloidal silver | silver | 0.066 |
| Gelatin | | 0.407 |
| ExM-1 | | 0.050 |
| ExF-1 | | $2.0 \times 10^{-3}$ |
| HBS-1 | | 0.074 |
| Solid disperse dye ExF-2 | | 0.015 |
| Solid disperse dye ExF-3 | | 0.020 |

| 3rd layer (Interlayer) | |
|---|---|
| Silver iodobromide emulsion O | 0.020 |
| ExC-2 | 0.022 |
| Polyethylacrylate latex | 0.085 |
| Gelatin | 0.294 |

| 4th layer (Low-speed red-sensitive emulsion layer) | | |
|---|---|---|
| Silver iodochlorobromide emulsion N | silver | 0.065 |
| Silver iodochlorobromide emulsion M | silver | 0.258 |
| ExC-1 | | 0.109 |
| ExC-3 | | 0.044 |
| ExC-4 | | 0.072 |
| ExC-5 | | 0.011 |
| ExC-6 | | 0.003 |
| Cpd-2 | | 0.025 |
| Cpd-4 | | 0.025 |
| HBS-1 | | 0.17 |
| Gelatin | | 0.80 |

| 5th layer (Medium-speed red-sensitive emulsion layer) | | |
|---|---|---|
| Silver iodobromide emulsion L | silver | 0.21 |
| Silver iodochlorobromide emulsion K | silver | 0.62 |
| ExC-1 | | 0.14 |
| ExC-2 | | 0.026 |
| ExC-3 | | 0.020 |
| ExC-4 | | 0.12 |
| ExC-5 | | 0.016 |
| ExC-6 | | 0.007 |
| Cpd-2 | | 0.036 |
| Cpd-4 | | 0.028 |
| HBS-1 | | 0.16 |
| Gelatin | | 1.18 |

| 6th layer (High-speed red-sensitive emulsion layer) | | |
|---|---|---|
| Silver Iodobromide emulsion 1-A of Example 1 | silver | 1.47 |
| ExC-1 | | 0.18 |
| ExC-3 | | 0.07 |
| ExC-6 | | 0.029 |
| ExC-7 | | 0.010 |
| ExY-5 | | 0.008 |
| Cpd-2 | | 0.046 |
| Cpd-4 | | 0.077 |
| HBS-1 | | 0.25 |
| HBS-2 | | 0.12 |
| Gelatin | | 2.12 |

| 7th layer (Interlayer) | |
|---|---|
| Cpd-1 | 0.089 |
| Solid disperse dye ExF-4 | 0.030 |
| HBS-1 | 0.050 |
| Polyethylacrylate latex | 0.83 |
| Gelatin | 0.84 |

| 8th layer (layer for donating interimage effect to red-sensitive layer) | |
|---|---|
| Silver iodochlorobromide emulsion J | silver 0.560 |
| Cpd-4 | 0.030 |
| ExM-2 | 0.096 |
| ExM-3 | 0.028 |
| ExY-1 | 0.031 |
| ExG-1 | 0.006 |
| HBS-1 | 0.085 |
| HBS-3 | 0.003 |
| Gelatin | 0.58 |

| 9th layer (Low-speed green-sensitive emulsion layer) | |
|---|---|
| Silver iodobromide emulsion I | silver 0.39 |
| Silver iodochlorobromide emulsion H | silver 0.28 |
| Silver iodochlorobromide emulsion G | silver 0.35 |
| ExM-2 | 0.36 |
| ExM-3 | 0.045 |
| ExG-1 | 0.005 |
| HBS-1 | 0.28 |
| HBS-3 | 0.01 |
| HBS-4 | 0.27 |
| Gelatin | 1.39 |

| 10th layer (Medium-speed green-sensitive emulsion layer) | |
|---|---|
| Silver iodobromide emulsion F | silver 0.45 |
| ExC-6 | 0.009 |
| ExM-2 | 0.031 |
| ExM-3 | 0.029 |
| ExY-1 | 0.006 |
| ExM-4 | 0.028 |
| ExG-1 | 0.005 |
| HBS-1 | 0.064 |
| HBS-3 | $2.1 \times 10^{-3}$ |
| Gelatin | 0.44 |

| 11th layer (High-speed green-sensitive emulsion layer) | |
|---|---|
| Silver iodobromide emulsion E | silver 0.99 |
| ExC-6 | 0.004 |
| ExM-1 | 0.016 |
| ExM-3 | 0.036 |
| ExM-4 | 0.020 |
| ExM-5 | 0.004 |
| ExY-5 | 0.003 |
| ExM-2 | 0.013 |
| ExG-1 | 0.005 |
| Cpd-4 | 0.007 |
| HBS-1 | 0.18 |

-continued

| 11th layer (High-speed green-sensitive emulsion layer) | |
|---|---|
| Polyethylacrylate latex | 0.099 |
| Gelatin | 1.11 |

| 12th layer (Yellow filter layer) | |
|---|---|
| Yellow colloidal silver | silver 0.047 |
| Cpd-1 | 0.16 |
| Solid disperse dye ExF-6 | 0.153 |
| Oil-soluble dye ExF-5 | 0.010 |
| HBS-1 | 0.082 |
| Gelatin | 1.057 |

| 13th layer (Low-speed blue-sensitive emulsion layer) | |
|---|---|
| Silver iodochlorobromide emulsion D | silver 0.18 |
| Silver iodobromide emulsion B | silver 0.20 |
| Silver iodochlorobromide emulsion C | silver 0.07 |
| ExC-1 | 0.041 |
| ExC-8 | 0.012 |
| ExY-1 | 0.035 |
| ExY-2 | 0.71 |
| ExY-3 | 0.10 |
| ExY-4 | 0.005 |
| Cpd-2 | 0.10 |
| Cpd-3 | $4.0 \times 10^{-3}$ |
| HBS-1 | 0.24 |
| Gelatin | 1.41 |

| 14th layer (High-speed blue-sensitive emulsion layer) | |
|---|---|
| Silver iodobromide emulsion A | silver 0.75 |
| ExC-1 | 0.013 |
| ExY-2 | 0.31 |
| ExY-3 | 0.05 |
| ExY-6 | 0.062 |
| Cpd-2 | 0.075 |
| Cpd-3 | $1.0 \times 10^{-3}$ |
| HBS-1 | 0.10 |
| Gelatin | 0.91 |

| 15th layer (1st protective layer) | |
|---|---|
| Silver iodobromide emulsion O | silver 0.30 |
| UV-1 | 0.21 |
| UV-2 | 0.13 |
| UV-3 | 0.20 |
| UV-4 | 0.025 |
| F-18 | 0.009 |
| F-19 | 0.005 |
| F-20 | 0.005 |
| HBS-1 | 0.12 |
| HBS-4 | $5.0 \times 10^{-2}$ |
| Gelatin | 2.3 |

| 16th layer (2nd protective layer) | |
|---|---|
| H-1 | 0.40 |
| B-1 (diameter 1.7 μm) | $5.0 \times 10^{-2}$ |
| B-2 (diameter 1.7 μm) | 0.15 |
| B-3 | 0.05 |
| S-1 | 0.20 |
| Gelatin | 0.75 |

In addition to the above components, to improve the storage stability, processability, resistance to pressure, antiseptic and mildewproofing properties, antistatic properties, and coating properties, the individual layers contained W-1 to W-5, B-4 to B-6, F-1 to F-18, iron salt, lead salt, gold salt, platinum salt, palladium salt, iridium salt, ruthenium salt, and rhodium salt. Additionally, the samples were prepared by adding $8.5\times10^{-3}$ g and $7.9\times10^{-3}$ g, per mol of a silver halide, of calcium in the form of an aqueous calcium nitrate solution to the coating solutions of the 8th and 11th layers, respectively. Preparation of dispersions of organic solid disperse dyes ExF-3 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700 mL pot mill, and 5.0 g of the dye ExF-3 and 500 mL of zirconium oxide beads (diameter 1 mm) were added to the mill. The contents were dispersed for 2 hr. This dispersion was done by using a BO type oscillating ball mill manufactured by Chuo Koki K.K. After the dispersion, the dispersion was extracted from the mill and added to 8 g of a 12.5% aqueous solution of gelatin. The beads were filtered away to obtain a gelatin dispersion of the dye. The average grain size of the fine dye grains was 0.24 μm.

Following the same procedure as above, solid dispersions ExF-4 was obtained. The average grain sizes of the fine dye grains was 0.45. ExF-2 was dispersed by a microprecipitation dispersion method described in Example 1 of EP549, 489A. The average grain size was found to be 0.06 μm.

A solid dispersion ExF-6 was dispersed by the following method.

4000 g of water and 376 g of a 3% solution of W-2 were added to 2,800 g of a wet cake of ExF-6 containing 18% of water, and the resultant material was stirred to form a slurry of ExF-6 having a concentration of 32%. Next, ULTRA VISCO MILL (UVM-2) manufactured by Imex K.K. was filled with 1,700 mL of zirconia beads having an average grain size of 0.5 mm. The slurry was milled by passing through the mill for 8 hr at a peripheral speed of about 10 m/sec and a discharge amount of 0.5 L/min.

(Preparation of solid fine dispersion of a sensitizing dye)

The sensitizing dyes of the invention were used in a form of a solid fine dispersion that was prepared in the method of JP-A-11-52507.

For example, solid fine dispersion of Sensitizing dye ExC-1 was prepared as follows.

0.8 parts by weight of $NaNO_3$ and 3.2 parts by weight of $Na_2SO_4$ were dissolved into 43 parts by weight of ion-exchanged water. 13 parts by weight of the sensitizing dye ExC-1 was added thereto and dispersed by using a dissolver blade at 2000 rpm for 20 min under the condition of 60° C. to obtain a solid dispersion of sensitizing dye ExC-1.

Compounds used in the formation of each layer were as follows.

ExC-1

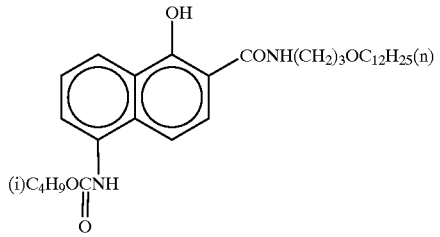

ExC-2

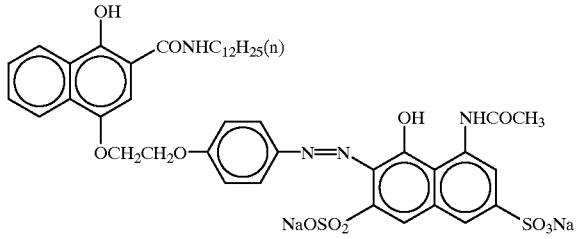

ExC-3

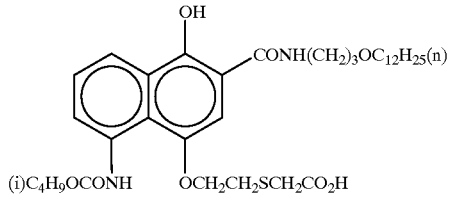

ExC-4

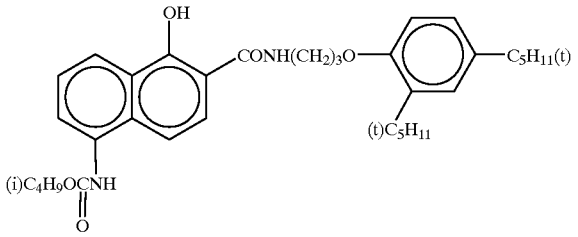

-continued
ExC-5
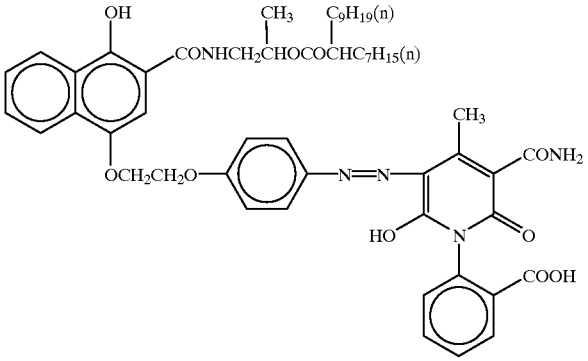
ExC-6
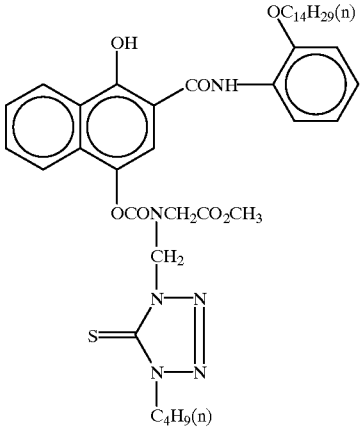
ExC-7
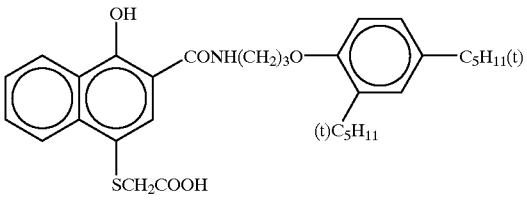
ExC-8
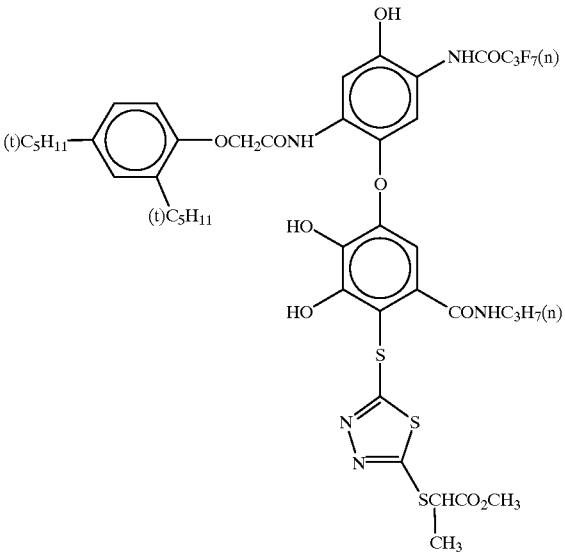
ExM-1
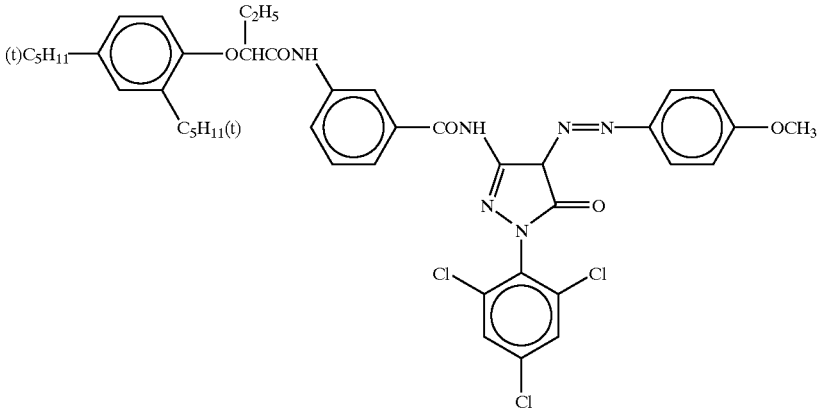

-continued
ExM-2
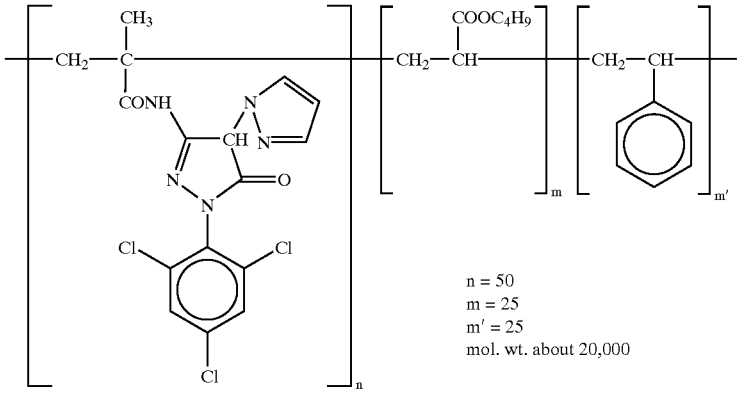
n = 50
m = 25
m′ = 25
mol. wt. about 20,000
ExM-3
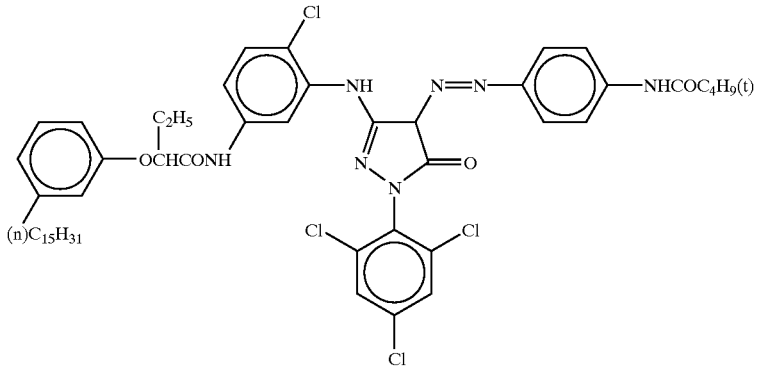
ExM-4
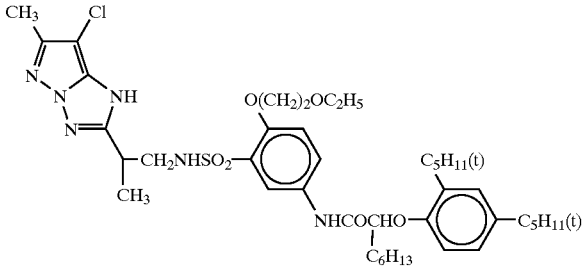
ExM-5
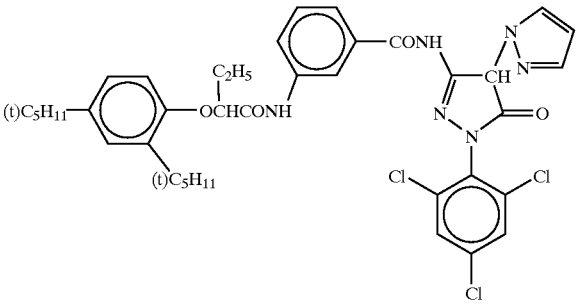
ExY-1
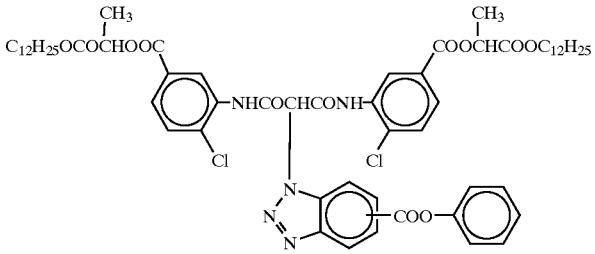
ExY-2
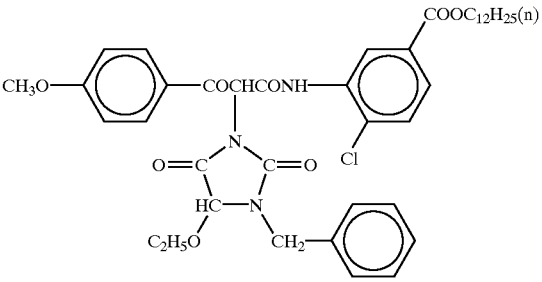

-continued
ExY-3
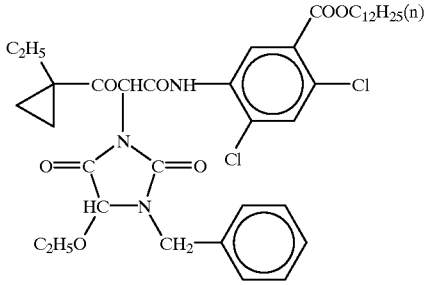
ExY-4
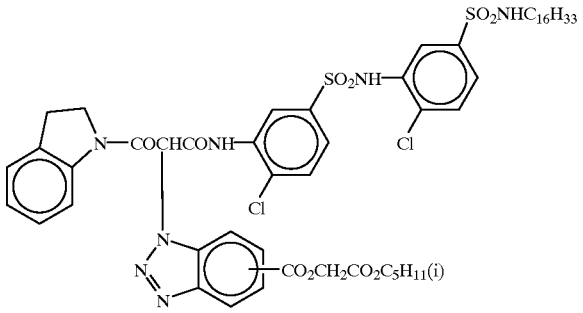
ExY-5
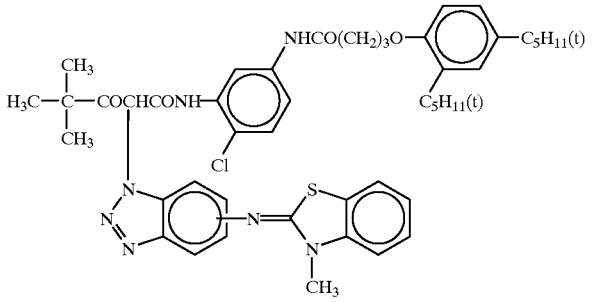
ExY-6
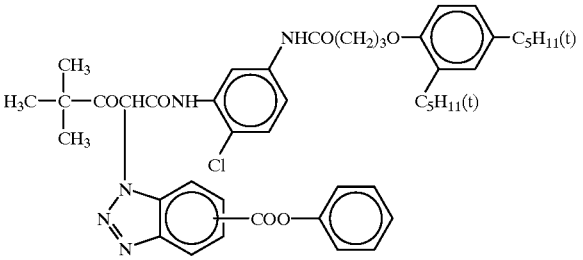
ExG-1
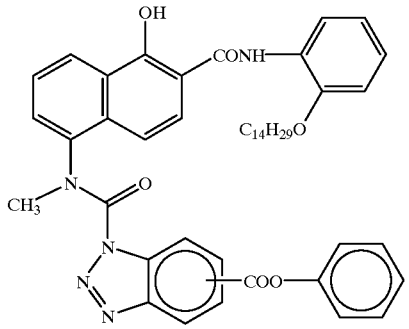
ExF-1
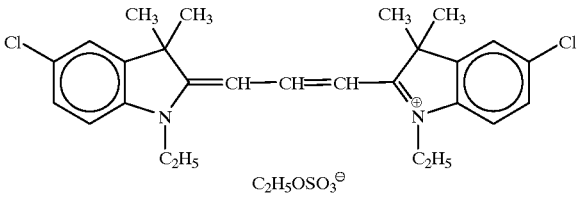
ExF-2
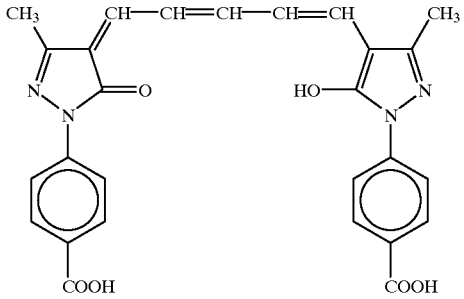
ExF-3
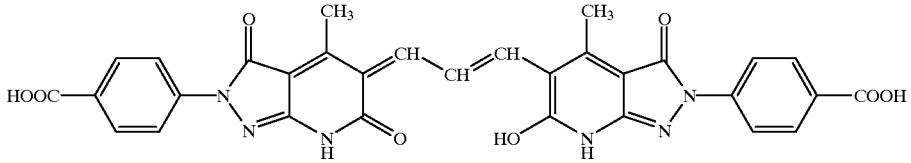

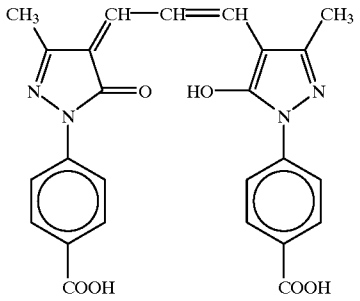
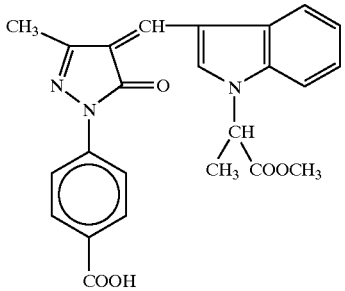
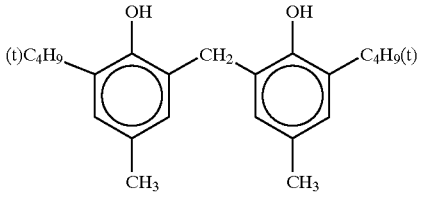
$n\text{-}C_{14}H_{29}OCOCH_2CH_2CONOH$
$\quad\quad\quad -continued
S-1
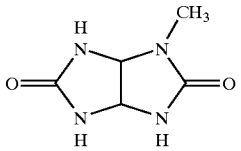
B-1
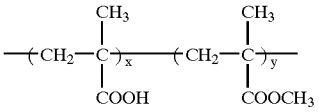
x/y = 10/90 (Weight ratio)
Average molecular weight: about 35,000
B-2
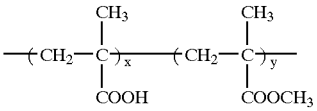
x/y = 40/60 (Weight ratio)
Average molecular weight: about 20,000
B-3
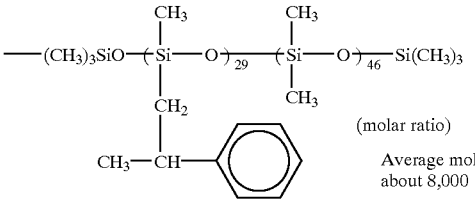
(molar ratio)
Average molecular weight: about 8,000
B-4
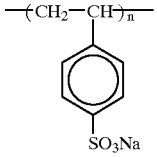
Average molecular weight: about 750,000
B-5
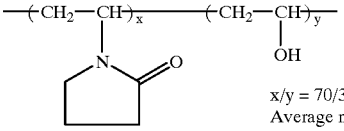
x/y = 70/30 (Weight ratio)
Average molecular weight: about 17,000
B-6
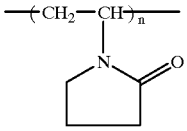
Average molecular weight: about 10,000
W-1
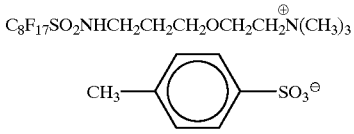
W-2
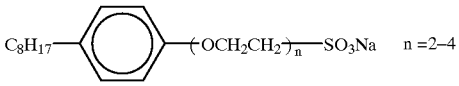
n =2–4
W-3
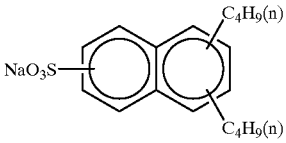
W-4
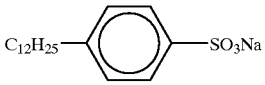
W-5
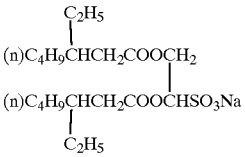
F-1
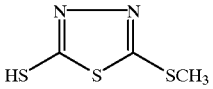
F-2
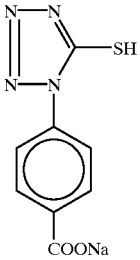
F-3
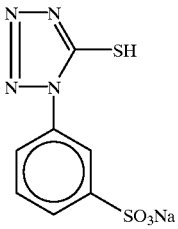
F-4
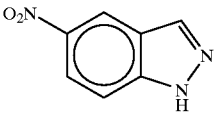

-continued

F-5

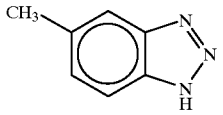

F-6

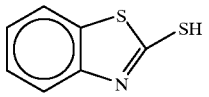

F-7

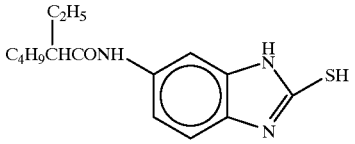

F-8

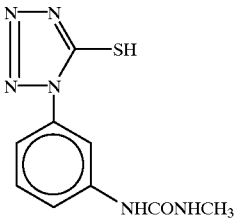

F-9

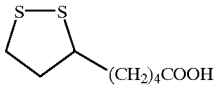

F-10

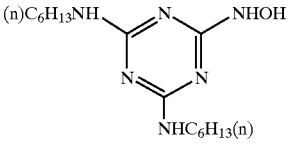

F-11

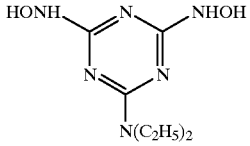

F-12

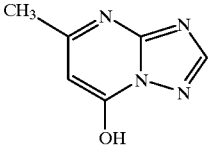

F-13

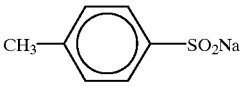

F-14

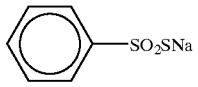

F-15

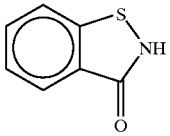

F-16

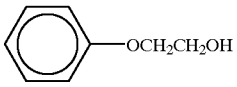

F-17

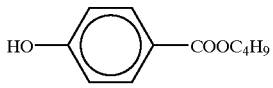

F-18

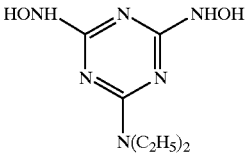

F-19

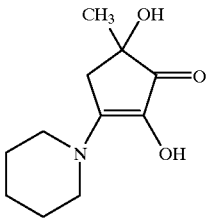

F-20

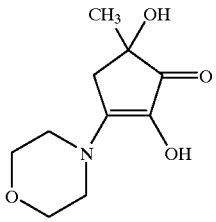

(Preparation of Samples 302 to 310)

Samples 302 to 310 were prepared by replacing Emulsion 1-A in the 6th layer with Emulsions 1-E, 1-F, I-I, 1-K, 1-N, 1-P, 1-S, 1-U, and 1-X, respectively.

These samples were subjected to film hardening treatment at 40 and a relative humidity of 70% for 14 hr.

After the treatment, for 10 sec exposure to $10^{-5}$ sec exposure, the samples were exposed to white light of 5500K color temperature through sharp cut filter SC-62, infrared cut filter and continuous wedge manufactured by Fuji Photo Film Co., Ltd. For $3\times10^{-9}$ sec exposure, exposure was performed by using laser light of 650 nm, and the below mentioned development processing was conducted.

The development was done as follows by using an automatic processor FP-360B manufactured by Fuji Photo Film Co., Ltd. Note that the processor was remodeled so that the overflow solution of the bleaching bath was not carried over to the following bath, but all of it was discharged to a waste fluid tank. The FP-360B processor was loaded with evaporation compensation means described in Journal of Technical Disclosure No. 94-4992.

The processing steps and the processing solution compositions are presented below.

(Processing steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60° C. | | |

*The replenishment rate was per 1.1 m of a 35-mm wide sensitized material (equivalent to one 24 Ex. 1)

The stabilizer and the fixing solution were counterflowed in the order of (2)→(1), and all of the overflow of the washing water was introduced to the fixing bath (2). Note that the amounts of the developer carried over to the bleaching step, the bleaching solution carried over to the fixing step, and the fixer carried over to the washing step were 2.5 mL, 2.0 mL and 2.0 mL per 1.1 m of a 35-mm wide sensitized material, respectively. Note also that each crossover time was 6 sec, and this time was included in the processing time of each preceding step.

The opening area of the above processor for the color developer and the bleaching solution were 100 $cm^2$ and 120 $cm^2$, respectively, and the opening areas for other solutions were about 100 $cm^2$.

The compositions of the processing solutions are presented below.

| | [Tank solution] (g) | [Replenisher] (g) |
|---|---|---|
| (Color developer) | | |
| Diethylenetriamine pentaacetic acid | 3.0 | 3.0 |
| Disodium catecohl-3,5-disulfonate | 0.3 | 0.3 |
| Sodium sulfite | 3.9 | 5.3 |
| Potassium carbonate | 39.0 | 39.0 |
| Disodium-N,N-bis (2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7 tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (adjusted by potassium hydroxide and surfuric acid) | 10.05 | 10.18 |

-continued

| | | |
|---|---|---|
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted by ammonia water) | 4.6 | 4.0 |
| (Fixer (1) Tank solution) | | |
| A 5:95 mixture (v/v) of the above bleaching tank solution and the below fixing tank solution pH 6.8 | | |
| (Fixer (2)) | | |
| Ammonium thiosulfate (750 g/L) | 240 mL | 720 mL |
| Imidazole | 7 | 21 |
| Ammonium Methanthiosulfonate | 5 | 15 |
| Ammonium Methanesulfinate | 10 | 30 |
| Ethylenediamine tetraacetic acid | 13 | 39 |
| Water to make | 1 L | 1 L |
| pH (adjusted by ammonia water and acetic acid) | 7.4 | 7.45 |

(Washing water)

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-mononyl phenylether (average polymerization degree 10) | 0.2 |
| Sodium 1,2-benzisothiazoline-3-on | 0.10 |
| Disodium ethylenediamine tetraacetate | 0.05 |
| 1,2,4-triazole | 1.3 |
| 1,4-bis(1,2,4-triazole-1-ylmethyl) piperazine | 0.75 |
| Water to make | 1.0 L |
| pH | 8.5 |

The photographic performance of the processed samples was evaluated by carrying out density measurement with the use of a red filter. The relative photographic speed was expressed by the relative value of inverse number of exposure quantity required for a cyan density to reach a density of fog density plus 0.15 at 1/100 sec exposure (assuming that the speed of sample 301 was 100). The speed difference between $10^{-5}$ sec exposure time and 10 sec exposure time and the speed difference between $3\times10^{-9}$ sec exposure time and $10^{-5}$ sec exposure time were expressed in terms of the speed unit of red-sensitive layer.

Subsequently, for evaluating the radiation resistance, the coated samples 301 to 310 were irradiated with γ-rays (1.173, 1.333 MeV) from radioactive isotope element $^{60}Co$ in a dose of 0.2 R and developed in the same manner as in the above light exposure. Density measurement was carried out with respect to cyan coloring to thereby determine the value of fog density. A fog increase attributed to exposure to radiation was determined from the determined fog density and the fog density of sample used in the previous light exposure, and the relative value to the fog increase of sample 301 was determined.

The results are listed in Table 6.

TABLE 6

| Sample No. | Emulsion used | A Relative sensitivity | Difference of sensitivities between exposure times of $10^{-5}$ sec and 10 sec | Difference of sensitivities between exposure times of $3 \times 10^{-9}$ sec and $10^{-5}$ sec | B Increment of fog due to exposure to radiation | A/B | Remarks |
|---|---|---|---|---|---|---|---|
| 301 | 1-A | 100 | 24 | 15 | 100 | 1.00 | Comparative example |
| 302 | 1-E | 74 | 82 | 85 | 62 | 1.19 | Invention |
| 303 | 1-F | 123 | 28 | 19 | 147 | 0.84 | Comparative example |
| 304 | 1-I | 126 | 50 | 63 | 112 | 0.13 | Invention |
| 305 | 1-K | 182 | 28 | 14 | 202 | 0.90 | Comparative example |
| 306 | 1-N | 186 | 51 | 59 | 151 | 1.23 | Invention |
| 307 | 1-P | 209 | 30 | 16 | 267 | 0.78 | Comparative example |
| 308 | 1-S | 214 | 56 | 72 | 174 | 1.23 | Invention |
| 309 | 1-U | 240 | 31 | 17 | 349 | 0.69 | Comparative example |
| 310 | 1-X | 245 | 55 | 74 | 170 | 1.44 | Invention |

The advantages of the present invention were conspicuous in the color negative multilayer as well in conformity with the results of Example 1.

The above evaluation was also made for the other emulsions prepared in Example 1. The relative relationship thereof was similar in the color negative multilayer as well.

The image photographed by the use of the negative film of sample 310 was inputted by negative scanning in digital labo system "Frontier" manufactured by Fuji Photo Film Co., Ltd. Digital image processing thereof (processing for graininess vanishing effect and sharpness intensification with color reproduction of color negative "Super 400" manufactured by Fuji Photo Film Co., Ltd.) was performed with the use of a work station, and the image was outputted by a laser printer. As a result, a photograph of excellent image quality was obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photographic lightsensitive material comprising at least one lightsensitive silver halide emulsion layer on a support, wherein the lightsensitive silver halide layer comprises an emulsion having a surface iodide content in a range of 4 to 8 mol % and having a (100) surface area ratio to the side faces of emulsion grains in a range of 5 to 35%, and wherein the lightsensitive material exhibits a speed at $3\times10^{-9}$ sec exposure time being lower than a speed at $10^{-5}$ sec exposure time by 30 or more in terms of speed unit.

2. The silver halide photographic lightsensitive material according to claim 1, wherein the lightsensitive material exhibits a speed at $10^{-5}$ sec exposure time being higher than a speed at 10 sec exposure time by 0 to 60 in terms of speed unit.

3. The silver halide photographic lightsensitive material according to claim 2, wherein the speed at $3\times10^{-9}$ sec exposure time is lower than the speed at $10^{-5}$ sec exposure time by 50 or more in terms of speed unit.

4. The silver halide photographic lightsensitive material according to claim 3, wherein the at least one lightsensitive silver halide emulsion layer comprises an emulsion containing silver halide grains having a variation coefficient of equivalent circle diameter distribution of all the silver halide grains in a range of 40 to 3%, and 50% or more of the total projected area of all the silver halide grains contained in the emulsion is occupied by silver iodobromide or silver iodochlorobromide tabular grains each having (111) faces as main planes and having an equivalent circle diameter of 3.0 $\mu$m or more and a thickness of 0.25 $\mu$m or less.

5. The silver halide photographic lightsensitive material according to claim 4, wherein the equivalent circle diameter and the thickness of each of the tabular grains that occupy 50% or more of the total projected area of all the silver halide grains are 3.0 $\mu$m or more and 0.15 $\mu$m or less, respectively.

6. The silver halide photographic lightsensitive material according to claim 4, wherein the equivalent circle diameter and the thickness of each of the tabular grains that occupy 50% or more of the total projected area of all the silver halide grains are 4.0 $\mu$m or more and 0.15 $\mu$m or less, respectively.

7. The silver halide photographic lightsensitive material according to claim 4, wherein the equivalent circle diameter and the thickness of each of the tabular grains that occupy 50% or more of the total projected area of all the silver halide grains are 4.0 $\mu$m or more and 0.10 $\mu$m or less, respectively.

8. The silver halide photographic lightsensitive material according to claim 4, wherein the lightsensitive material comprises at least one blue-sensitive layer, at least one green-sensitive layer and at least one red-sensitive layer on the support, and exhibits a speed of ISO 400 or more.

9. The silver halide photographic lightsensitive material according to claim 3, wherein the lightsensitive material comprises at least one blue-sensitive layer, at least one green-sensitive layer and at least one red-sensitive layer on the support, and exhibits a speed of ISO 400 or more.

10. The silver halide photographic lightsensitive material according to claim 2, wherein the at least one lightsensitive silver halide emulsion layer comprises an emulsion containing silver halide grains having a variation coefficient of equivalent circle diameter distribution of all the silver halide grains in a range of 40 to 3%, and 50% or more of the total projected area of all the silver halide grains contained in the emulsion is occupied by silver iodobromide or silver iodochlorobromide tabular grains each having (111) faces as main planes and having an equivalent circle diameter of 3.0 μm or more and a thickness of 0.25 μm or less.

11. The silver halide photographic lightsensitive material according to claim 10, wherein the equivalent circle diameter and the thickness of each of the tabular grains that occupy 50% or more of the total projected area of all the silver halide grains are 3.0 μm or more and 0.15 μm or less, respectively.

12. The silver halide photographic lightsensitive material according to claim 10, wherein the equivalent circle diameter and the thickness of each of the tabular grains that occupy 50% or more of the total projected area of all the silver halide grains are 4.0 μm or more and 0.15 μm or less, respectively.

13. The silver halide photographic lightsensitive material according to claim 10, wherein the equivalent circle diameter and the thickness of each of the tabular grains that occupy 50% or more of the total projected area of all the silver halide grains are 4.0 μm or more and 0.10 μm or less, respectively.

14. The silver halide photographic lightsensitive material according to claim 10, wherein the lightsensitive material comprises at least one blue-sensitive layer, at least one green-sensitive layer and at least one red-sensitive layer on the support, and exhibits a speed of ISO 400 or more.

15. The silver halide photographic lightsensitive material according to claim 2, wherein the lightsensitive material comprises at least one blue-sensitive layer, at least one green-sensitive layer and at least one red-sensitive layer on the support, and exhibits a speed of ISO 400 or more.

16. The silver halide photographic lightsensitive material according to claim 1, wherein the at least one lightsensitive silver halide emulsion layer comprises an emulsion containing silver halide grains having a variation coefficient of equivalent circle diameter distribution of all the silver halide grains in a range of 40 to 3%, and 50% or more of the total projected area of all the silver halide grains contained in the emulsion is occupied by silver iodobromide or silver iodochlorobromide tabular grains each having (111) faces as main planes and having an equivalent circle diameter of 3.0 μm or more and a thickness of 0.25 μm or less.

17. The silver halide photographic lightsensitive material according to claim 16, wherein the equivalent circle diameter and the thickness of each of the tabular grains that occupy 50% or more of the total projected area of all the silver halide grains are 3.0 μm or more and 0.15 μm or less, respectively.

18. The silver halide photographic lightsensitive material according to claim 16, wherein the equivalent circle diameter and the thickness of each of the tabular grains that occupy 50% or more of the total projected area of all the silver halide grains are 4.0 μm or more and 0.15 μm or less, respectively.

19. The silver halide photographic lightsensitive material according to claim 16, wherein the equivalent circle diameter and the thickness of each of the tabular grains that occupy 50% or more of the total projected area of all the silver halide grains are 4.0 μm or more and 0.10 μm or less, respectively.

20. The silver halide photographic lightsensitive material according to claim 1, wherein the lightsensitive material comprises at least one blue-sensitive layer, at least one green-sensitive layer and at least one red-sensitive layer on the support, and exhibits a speed of ISO 400 or more.

21. The silver halide photographic lightsensitive material according to claim 16, wherein the lightsensitive material comprises at least one blue-sensitive layer, at least one green-sensitive layer and at least one red-sensitive layer on the support, and exhibits a speed of ISO 400 or more.

22. The silver halide photographic lightsensitive material according to claim 1, wherein the silver halide grains contained in the emulsion comprise iridium in an amount of $1\times10^{-10}$ to $1\times10^{-8}$ mol per mol of silver halide.

23. The silver halide photographic lightsensitive material according to claim 22, where in the silver halide grains contained in the emulsion comprise a gold sensitizer in an amount of $1\times10^{-8}$ to $1\times10^{-6}$ mol per mol of silver halide.

24. The silver halide photographic lightsensitive material according to claim 1, wherein the silver halide grains contained in the emulsion comprise a gold sensitizer in an amount of $1\times10^{-8}$ to $1\times10^{-6}$ mol per mol of silver halide.

* * * * *